United States Patent [19]

Gnuechtel et al.

[11] Patent Number: 4,991,761

[45] Date of Patent: Feb. 12, 1991

[54] WEB GUIDE APPARATUS

[75] Inventors: Herman C. Gnuechtel, Arlington Heights; Stephen P. Kosmen, Hoffman Estates, both of Ill.

[73] Assignee: Web Printing Controls Co., Inc., Barrington, Ill.

[21] Appl. No.: 265,423

[22] Filed: Oct. 31, 1988

[51] Int. Cl.[5] ..... B65H 25/26; G01N 21/86; G01V 9/04

[52] U.S. Cl. ..... 226/15; 226/18; 250/560

[58] Field of Search ..... 226/15, 18, 19, 20, 226/21, 22; 242/57.1; 250/560

[56] References Cited

U.S. PATENT DOCUMENTS

| | | | |
|---|---|---|---|
| 3,373,288 | 3/1968 | Otepka et al. | 226/20 X |
| 3,615,048 | 10/1971 | Martin | 226/20 |
| 4,015,843 | 4/1977 | Tennant | 226/19 X |
| 4,069,959 | 1/1978 | Bartell et al. | 226/21 |
| 4,204,619 | 5/1980 | Damour | 226/21 |
| 4,243,167 | 1/1981 | Sander | 226/21 |
| 4,291,825 | 9/1981 | Glanz | 226/18 |
| 4,361,260 | 11/1982 | Hanlan | 226/30 |
| 4,384,686 | 5/1983 | Wiley et al. | 242/57.1 |
| 4,528,630 | 7/1985 | Sargent | 364/469 |
| 4,719,575 | 1/1988 | Gnuechtel | 364/469 |
| 4,848,632 | 7/1989 | Mack et al. | 226/18 |

*Primary Examiner*—Daniel P. Stodola
*Assistant Examiner*—Paul T. Bowen
*Attorney, Agent, or Firm*—Welsh & Katz, Ltd.

[57] ABSTRACT

A microprocessor-controlled web guidance system which automatically implements and maintains a proper lateral web alignment of a continuous web in a web printing press. A steering mechanism is provided which is controlled by a microprocessor system which utilizes infrared radiation for edge detection wherein multiple sensors are driven by means of stepper motors driving on a flexible linear cogged belt system. The system includes novel functions, and diagnostic and maintenance modes which may be programmed by the operator. A plurality of control panels are provided to enable the operator to select and program desired functions and to access desired modes. Self calibration and testing of the steering mechanism and the edge sensors is also provided.

17 Claims, 8 Drawing Sheets

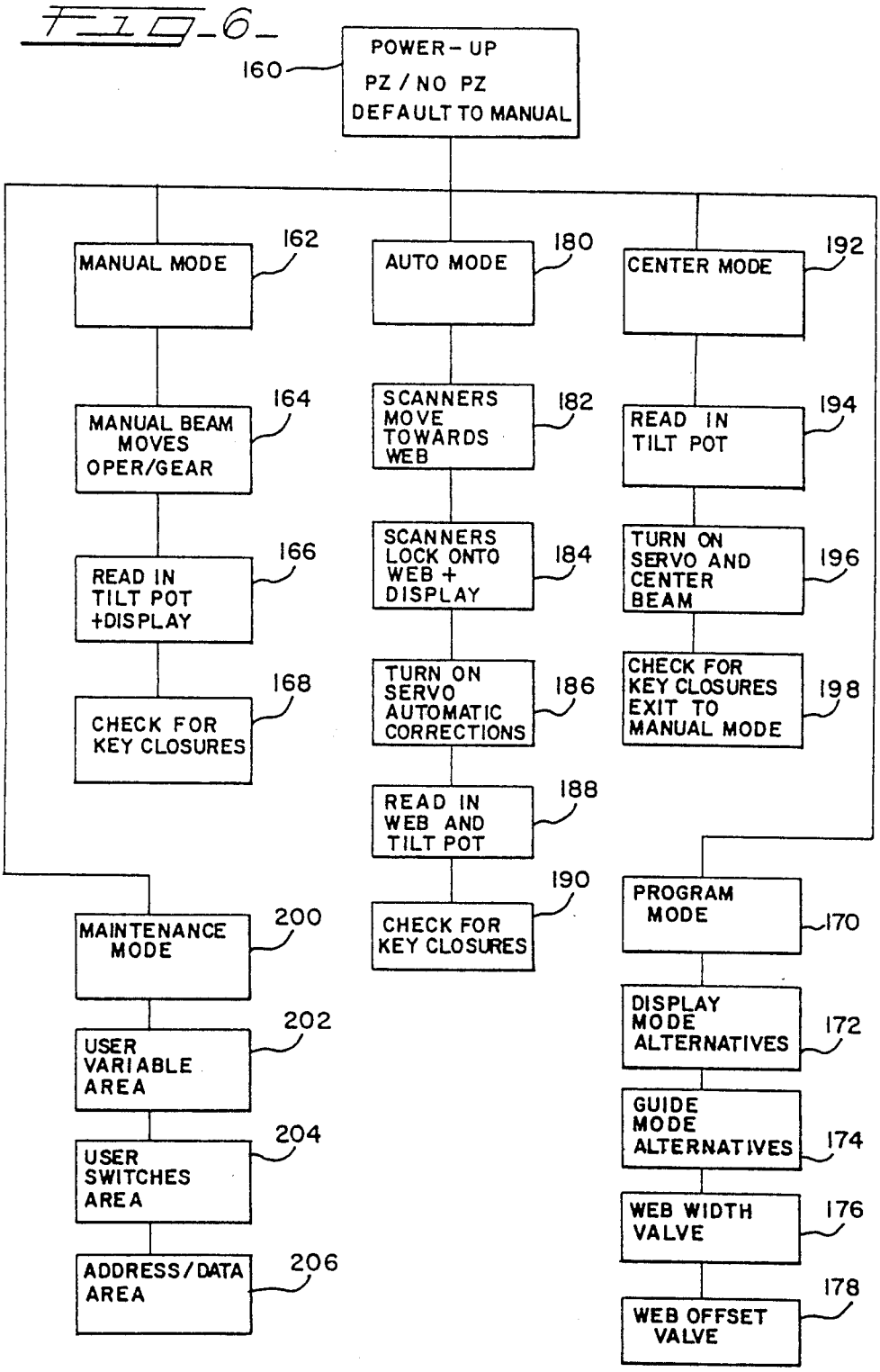
FIG-6
160
POWER-UP
PZ / NO PZ
DEFAULT TO MANUAL
MANUAL MODE
162
MANUAL BEAM MOVES OPER/GEAR
164
READ IN TILT POT +DISPLAY
166
CHECK FOR KEY CLOSURES
168
AUTO MODE
180
SCANNERS MOVE TOWARDS WEB
182
SCANNERS LOCK ONTO WEB + DISPLAY
184
TURN ON SERVO AUTOMATIC CORRECTIONS
186
READ IN WEB AND TILT POT
188
CHECK FOR KEY CLOSURES
190
CENTER MODE
192
READ IN TILT POT
194
TURN ON SERVO AND CENTER BEAM
196
CHECK FOR KEY CLOSURES EXIT TO MANUAL MODE
198
MAINTENANCE MODE
200
USER VARIABLE AREA
202
USER SWITCHES AREA
204
ADDRESS/DATA AREA
206
PROGRAM MODE
170
DISPLAY MODE ALTERNATIVES
172
GUIDE MODE ALTERNATIVES
174
WEB WIDTH VALVE
176
WEB OFFSET VALVE
178

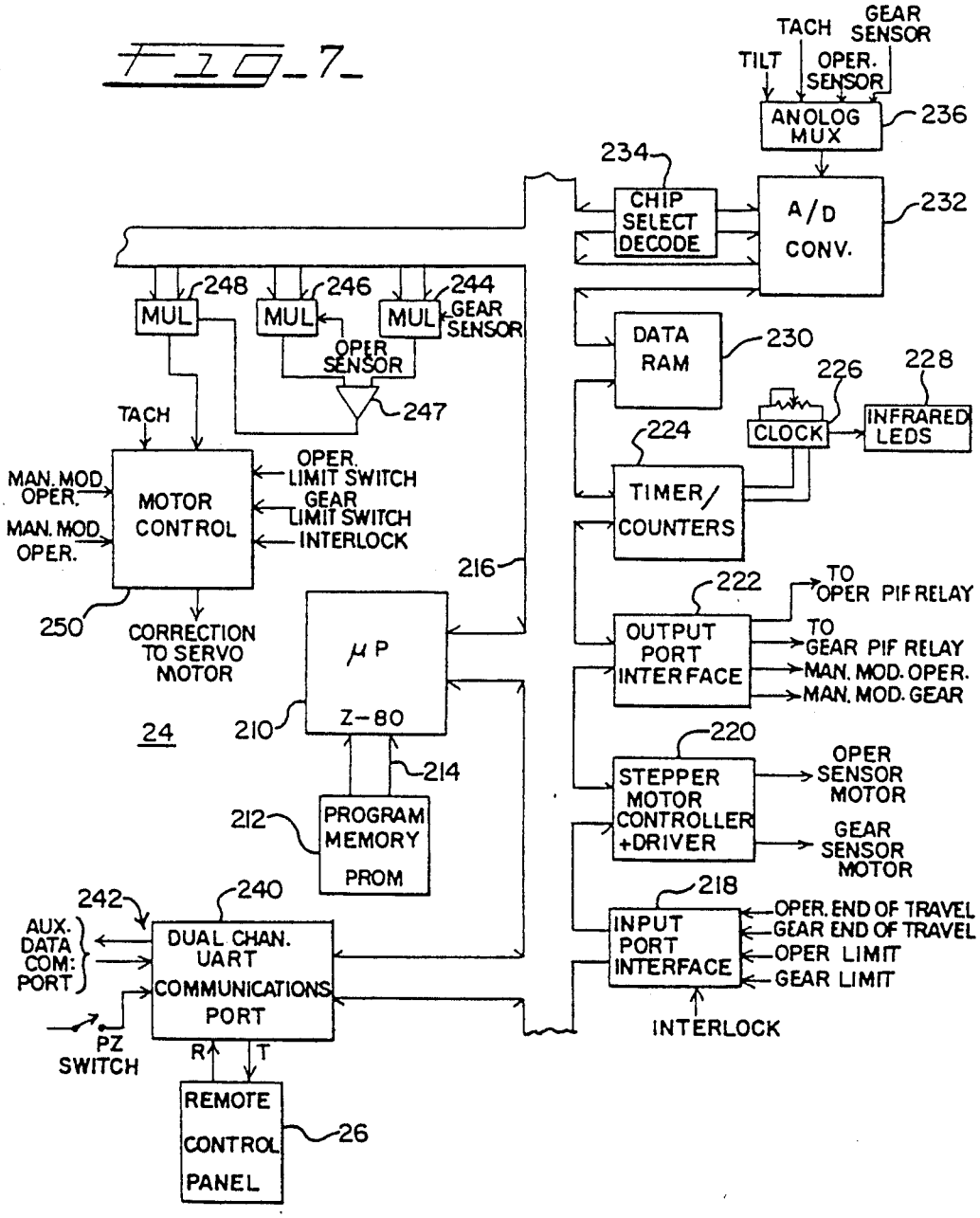
FIG. 7
TACH
GEAR SENSOR
TILT
OPER. SENSOR
ANOLOG MUX
236
234
CHIP SELECT DECODE
A/D CONV.
232
248
246
244
MUL
MUL
MUL
GEAR SENSOR
OPER SENSOR
247
DATA RAM
230
226
228
CLOCK
INFRARED LEDS
TACH
224
MAN. MOD OPER.
MOTOR CONTROL
OPER. LIMIT SWITCH
GEAR LIMIT SWITCH
INTERLOCK
MAN. MOD OPER.
TIMER/ COUNTERS
216
222
TO OPER PIF RELAY
250
CORRECTION TO SERVO MOTOR
μP
Z-80
OUTPUT PORT INTERFACE
TO GEAR PIF RELAY
MAN. MOD. OPER.
MAN. MOD. GEAR
24
210
220
214
STEPPER MOTOR CONTROLLER +DRIVER
OPER SENSOR MOTOR
212
PROGRAM MEMORY PROM
GEAR SENSOR MOTOR
242
240
218
AUX. DATA COM: PORT
DUAL CHAN. UART COMMUNICATIONS PORT
INPUT PORT INTERFACE
OPER. END OF TRAVEL
GEAR END OF TRAVEL
OPER LIMIT
GEAR LIMIT
INTERLOCK
PZ SWITCH
R
T
REMOTE CONTROL PANEL
26

WEB GUIDE APPARATUS

BACKGROUND OF THE INVENTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

This invention relates generally to web handling apparatus and more particularly to a microprocessor controlled web guidance system to automatically implement and maintain proper lateral web alignment of a continuous web in a web handling system such as a printing press. In numerous industrial commercial processes, operations are performed in a continuous travelling web of a thin material, such as paper or plastic film, etc., which move through machines at high speed. Such web process operations include, for example, printing of newspapers or magazines, coating the moving web, slitting the moving web lengthwise, cutting the moving web transversely, etc. These operations usually require accurate lateral alignment of the web to maintain the web in proper registry with the machine that operates on the web. However, the moving web often shifts laterally from a proper lateral position on the rollers supporting it resulting in lateral misalignment relative to the machine. This displacement of the web from its proper lateral position interferes with the operations being performed on the web and often results in wastage and/or a crash of the web handling system. Thus, it is usually necessary to correct any misalignment as promptly as possible. Consequently, web guide devices which sense the lateral position of the web and automatically adjust the lateral position of the web when it deviates from a desired position are commonly used in the art.

It is known in the art to use web guide apparatus which includes a stationary support frame with a moveable steering frame mounted on the support frame. This moveable frame is steered by an appropriate positioning device such as a hydraulic cylinder or an electric motor, and normally includes a pair of spaced, parallel steering rollers over which the web is run. A sensor detects the lateral position of the web as it leaves the steering rollers and generates a signal to control the steering frame positioning motor. The moveable steering frame is pivoted relative to the support frame by the positioning motor about a pivot point along the center line axis of the incoming web. This pivoting action moves the rollers such that the web is repositioned laterally as it moves along and over the guide rollers.

In some prior art web guide apparatus, the sensing of the alignment of the moving head is accomplished by using a single web edge detector, such as a photodetector or infrared detector, positioned at one lateral edge of the moving web to detect transverse displacement of the web edge. In other situations, the width of the moving web may vary so that two edge detectors have been used to monitor both edges of the web. In addition, moveable edge detectors have been used in the prior art. Systems have also been proposed which provide a digital readout display of the correction being made to the position of the web.

Prior art web guide systems have numerous deficiencies. Such systems do not provide diagnostic and maintenance modes of operation to aide in the operation of the apparatus. Inability to calibrate the tilt mechanism makes it difficult to set trip points to stop or adjust the web handling line. These limitations often lead to undesirable and expensive crashes of the web handling line. In addition, control and drive mechanisms for the movement of the edge sensors has been inadequate leading to failure to keep track of sensor position and inaccurate position of the sensor due to gear backlash. The present invention overcomes these and other deficiencies of the prior art web guide apparatus and provides new and additional features not heretofore available.

Accordingly, it is an object of the present invention to provide a novel microprocessor controlled web guidance system having novel maintenance and diagnostic features.

It is another object of the invention to provide a novel microprocessor controlled web guidance system having a novel tilt mechanism calibration system for calibrating the full scale gain of the tilt mechanism.

It is yet another object of the invention to provide a novel microprocessor controlled web guidance system having a novel edge sensor drive mechanism utilizing a cogged linear belt in conduction with stepper motors and counting means to keep track of the edge sensor position.

It is still another object of the invention to provide a novel microprocessor controlled web guidance system having a plurality of control panels with serial communications between the control panels and the control circuitry.

Briefly, according to one embodiment of the invention, a web guidance system is provided for automatically controlling alignment of a moving web. The system comprises a stationary support frame and a pivotable frame attached to the support frame and pivotable over a predetermined range, including parallel steering rollers for receiving the moving web. Sensing means is provided including at least one edge sensor positionable along either longitudinal edge of the web for sensing a transverse deviation in the position in the longitudinal edge of the web and for generating an error signal in response thereto. Control means is provided for generating a control signal responsive to the error signal for automatically correcting the deviation of the web position, and drive means is provided for controlling the angular position of said pivotable frame by pivoting the pivotable frame responsive to the control signals. In addition, manual means are provided to enable an operator to assume manual control of the drive means, and maintenance means provides maintenance modes of operation and can enable an operator to select functions and diagnostic, self-calibrating or maintenance modes of operation.

BRIEF DESCRIPTION OF THE DRAWINGS

The features of the present invention which are believed to be novel are set forth below with particularity in the appended claims. The invention, together with further objects and advantages thereof, may be understood by reference to the following description taken in conjunction with the accompanying drawings.

FIG. 6 is a flow diagram illustrating the processing flow and logical methodology of the program for the control circuitry of the web guide system shown in FIG. 1.

FIG. 7 is detailed block diagram illustrating a specific embodiment of the circuitry for the control circuitry shown in FIG. 1.

DETAILED DESCRIPTION OF THE PREFERRED EMBODIMENT

Figure 1:
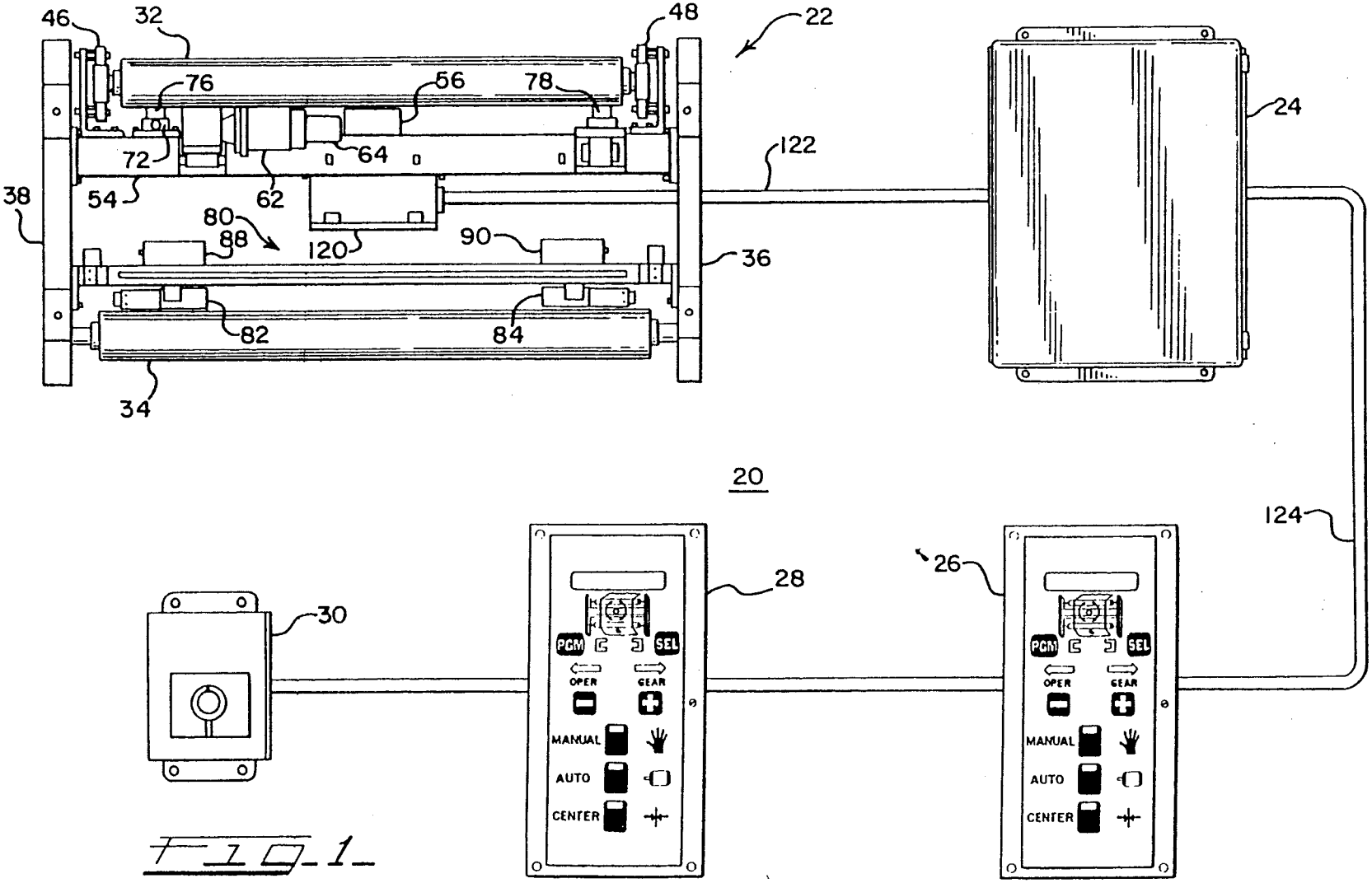
FIG. 1 is a diagrammatic illustration of a specific embodiment of a web guide system in accordance with the invention.

Referring to FIG. 1 there is shown a diagrammatic illustration of a web guide system 20 in accordance with the present invention for use with a web printing press. The system 20 includes a web guide assembly 22, control circuitry 24, a control panel 26, an optional remote control panel 28, and an optional auxiliary control panel 30. The web guide assembly 22 is shown with a front view having a exit steering 32, which forms the exit roller of the steering or tilt mechanism, shown in more detail in FIG. 3A, and having a lower exit roller 34, functioning as an exit roller. The rollers 32 and 34 are mounted on a stationary frame composed of a gear edge plate 36 and an operator edge plate 38. Near the exit roller 34 a scanner mechanism 80 having two edge sensors 82, 84 is mounted to the gear edge plate 36 and operator edge plate 38, as shown. The terms "gear" and "operator" are commonly used in the art, and are used herein to designate a particular side of the press, the "operator" side being where the operator normally works, and the "gear" side being where the press drive gear mechanism is normally located.

Figure 2:
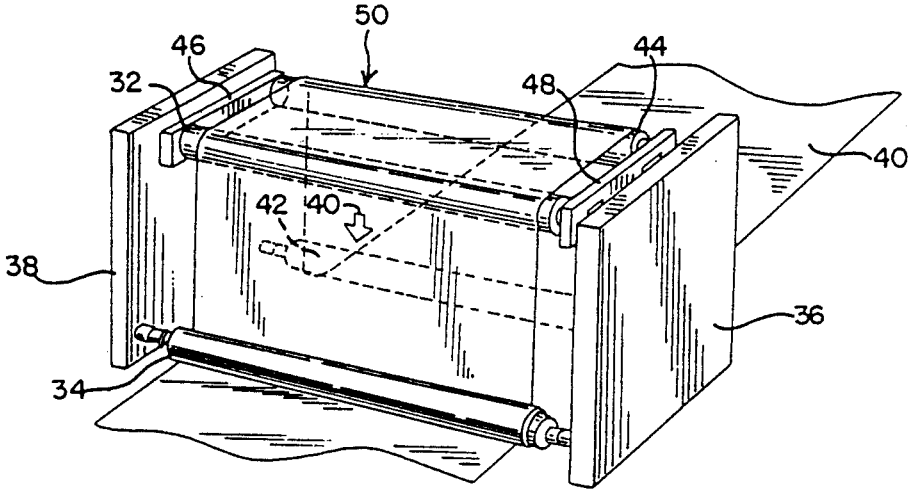
FIG. 2 is a perspective view of portions of a specific embodiment of the web guide assembly shown in FIG. 1 with parts removed to illustrate a web threaded therethrough.

FIG. 2 is a perspective view of the web guide assembly 22 with portions removed to illustrate a specific example of the travel of the web 40 through the assembly 22. The web 40 is threaded from an idler entrance roller 42 over an lead-in steering roller 44 and the exit steering roller 32 and under the exit roller 34, as shown. The steering rollers 32 and 44 form a steering mechanism 50, and are rotatably mounted on the steering roller support members 46, 48.

Figure 3A:
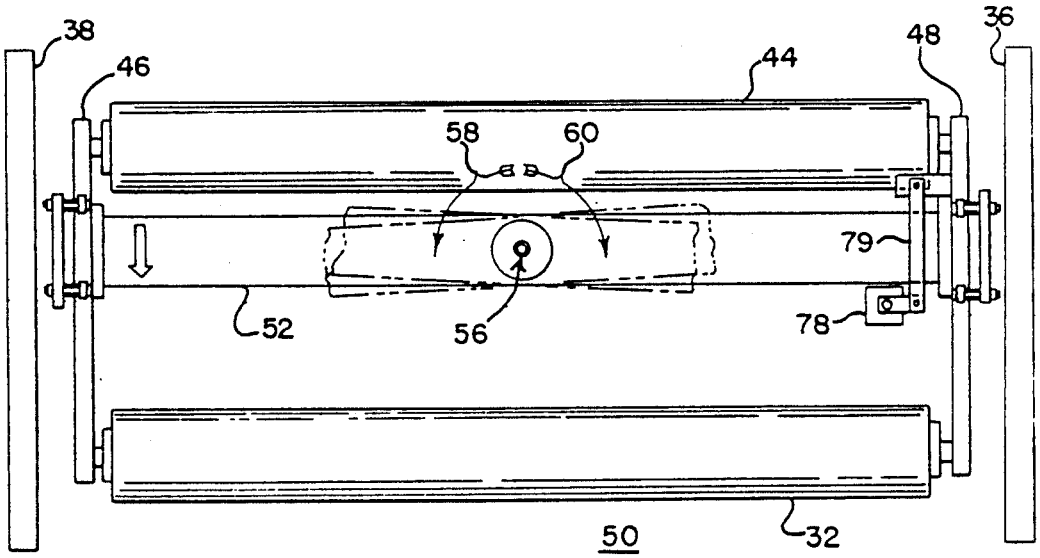
FIG. 3A is a top view illustrating a specific embodiment of the steering roller assembly of the web guide assembly shown in FIG. 1.
Figure 3B:
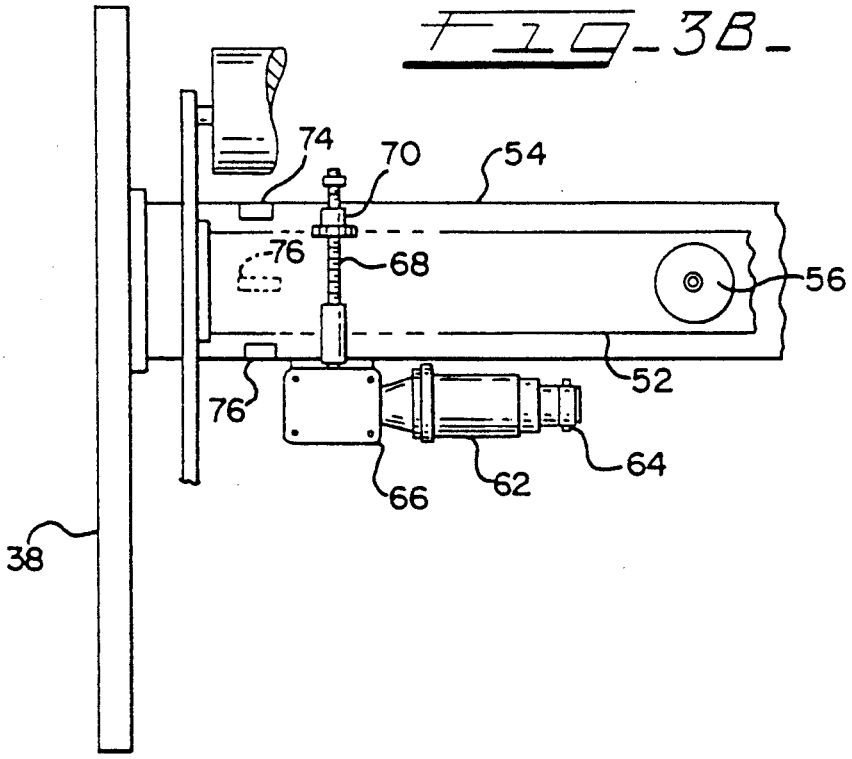
FIG. 3B is a top view of a portion of the steering assembly shown in FIG. 3A.
Figure 3C:
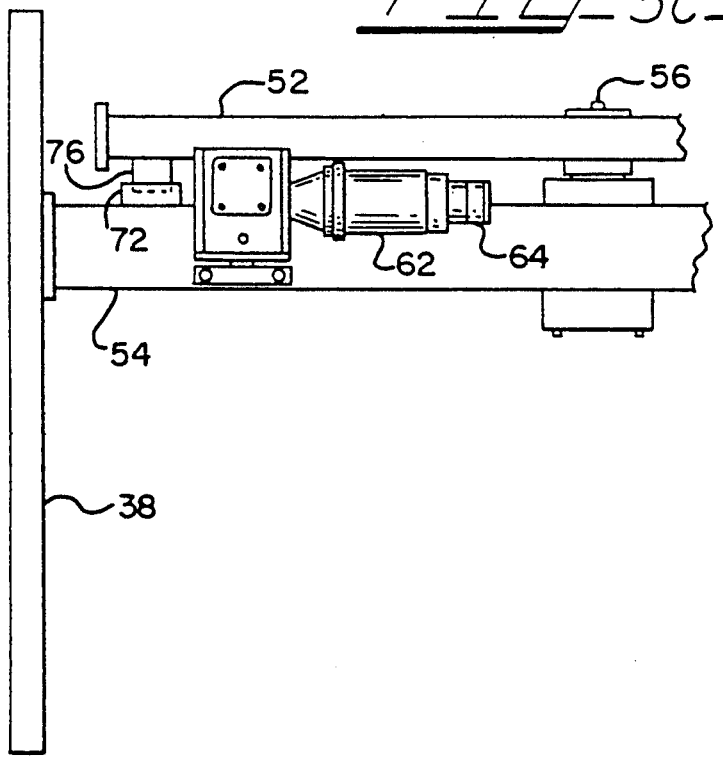
FIG. 3C is side view of a portion of the steering assembly shown in FIG. 3A.

The steering mechanism 50 is illustrated in greater detail in FIGS. 3A, 3B, and 3C. FIG. 3A is a top view of the steering assembly 50, with the drive mechanism removed, having the side members 46, 48 mounted on a steering pivot beam 52. The pivot beam 52 is mounted on a support cross-member 54 (See FIG. 1 and FIG. 3B) by means of a pivot mechanism 56. The support cross-member 54 is mounted on the stationary frame side plates 36, 38 as shown in FIG. 1. The pivot mechanism allows the steering assembly 50 composed of the lead-in and exit steering rollers 44, 32, the side members 46, 48, and the pivot beam 52 to be angularly pivoted (tilted) about the axis of the pivot mechanism 56 in the directions shown by the arrows 58, 60 relative to the support cross-member 54. An offset center pivot is utilized with the pivot 56 offset toward the lead-in side of the steering mechanism 50 to provide the greatest web movement as a function of pivot position with respect to minimum web distortion. The offset also pushes the web in the direction of the correction thereby yielding a faster correction rate. A tilt potentiometer 78 is also coupled to the steering mechanism 50 by a coupling mechanism 79 and mounted on the support cross member 54. The tilt potentiometer 78 provides a position signal which permits the control circuitry 24 to monitor the relative position of the steering pivot beam 52.

The pivot beam 52 is driven angularly in either direction by a drive means including a DC motor 62, as shown in the top view of a portion of the steering mechanism 50 illustrated in FIG. 3B. The motor 62 includes a tachometer 64, and is coupled to a gear box 66 mounted on the support cross-member 54. A lead screw gear assembly 68 extending from the gear box 66 and driven by the motor 62 drives the pivot beam 52 to the desired angular position by interaction with a ball bearing nut assembly 70 mounted on the pivot beam 52, as shown. The tachometer 52 permits the system control circuitry 24 to monitor the speed at which the beam is pivoted and uses this signal as a feedback signal to aid in controlling the correction motor 62. Limit switches 72, 74 mounted on the support cross-member 54 interact with a paddle 76 to provide a limit signal to the control circuitry 24 when the pivot beam 52 reaches maximum permitted angular displacement. The structure of the steering assembly 50 may be more fully appreciated by inspection of the side view of a portion of the steering mechanism illustrated in FIG. 3C.

Figure 4B:
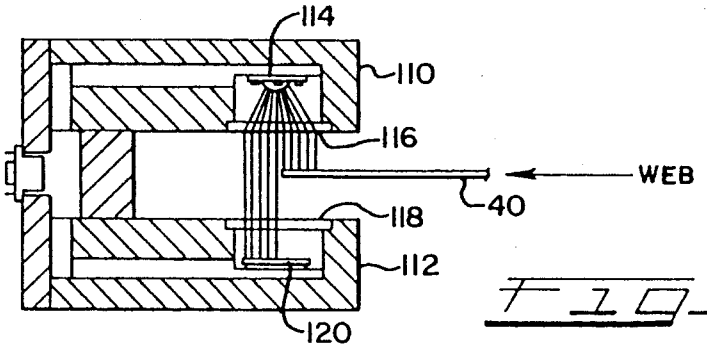
FIG. 4B is a diagrammatic cross-sectional top view of the scanner edge sensor shown in FIG. 4A.
Figure 4A:
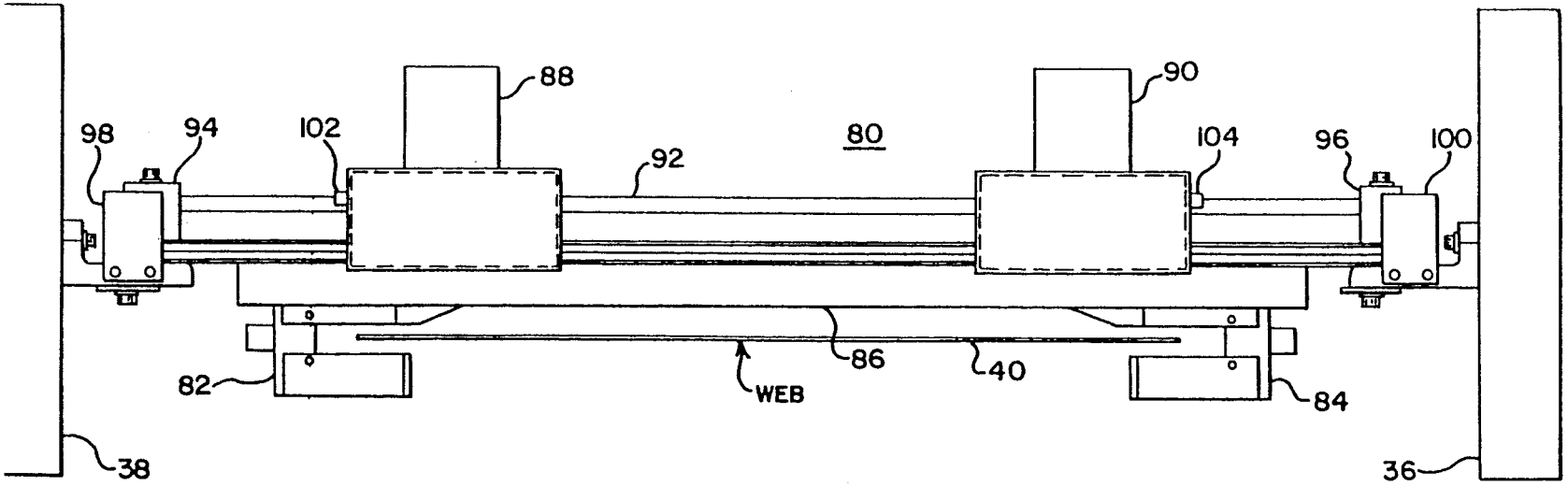
FIG. 4A is a top view illustrating a specific embodiment of the scanner mechanism according to the invention.

Referring now to FIG. 4A there is illustrated a top view of specific embodiment of the scanner mechanism 80 shown in FIG. 1. The scanner mechanism 80 is mounted on the operator edge support plate 38 and gear edge support plate 36 of the stationary support frame, as shown. The scanner mechanism includes two movable edge sensors, an operator edge sensor 82 and a gear edge sensor 84 movably mounted on a scanner bar 86. The edge sensors 82, 84 are also coupled to drive means comprising an operator sensor synchronous stepper motor 88 and a gear sensor synchronous stepper motor 90 which are movably mounted to engage a linear cogged belt 92 having cogs 91. This structure enables backlash free movement of the sensors 82, 84 by the independent stepper motors 88, 90 while ensuring accurate location of the sensors. The stepper motors 88, 90 are controlled by signals coupled from the control logic 24. An operator side tensioner 94 is provided, as shown, to ensure proper tension of the belt 92. An operator end of travel block 98 and gear end of travel block 100 interact with end of travel sensors 102 and 104, respectively, to provide end of travel signals to the control circuitry 24.

The operation of the edge sensors 82, 84 is illustrated in the diagrammatic cross sectional top view of an edge sensor in FIG. 4B. constructed having two separated arm portions 110 and 112, as shown. In one arm 110 is located a source of radiation 114 emitting infrared light in the illustrant. The infrared light emitted by the source 114 is modulated by a 2 KHz modulating signal in the illustrated embodiment to mask out ambient light. In addition, a transparent cover 116 is mounted, as shown, and the infrared light radiates through the cover 116 into a channel having a width which encompasses the typical range of web edge deviation from a desired or predetermined position. In the other arm 112 of the sensor is another transparent cover 118 which passes the portion of the infrared light that passes the edge of the web 140 extending between the arms 112, 114. A detector 120, such as an infrared photocell, receives the infrared radiation and produces an input signal corresponding to the magnitude of the infrared radiation impinging upon the detector 120. As shown, the sensor is positioned such that the web blocks part of the light path. Thus, the amount of infrared radiation block is directly proportional to the web position and the signal generated by the detector 120 is directly related to the web position.

Two sensors are supplied with the system to permit several types of operation. When guiding in the center mode using two sensors the system essentially compares the output of both sensors and adjusts the steering mechanism to position the web such that the signal from both sensors is equal. When edge guiding the system compares the output of the selected sensor with a preset constant. This preset constant is set such that the steering mechanism positions the web in the middle of the sensor. In the center mode using both sensors, the centerline of the web is what the system accurately holds in position. In the edge mode, the edge selected is the side the system holds accurately.

The web guide assembly 22, including the steering mechanism motor 62 and the sensor motors 88, 90 is controlled by control signals coupled via a junction block 120 and a cable 122 to the web guide assembly 22 from the control circuitry 24, as shown in FIG. 1, to provide control of the course of the web 40, either automatically or manually. The control circuitry 24 is described in greater detail hereinafter with reference to FIGS. 7 and 9. Operator control of the circuitry is provided by a control panel 26, and optional additional control panels including a number of additional remote panels 28 and auxiliary control 30, as shown. The control panels 26 and 28, are identical and permit operator control of the web guidance system 20 while the auxiliary control permits manual adjustment of the steering mechanism 50. The control panels 26, 28, 30 are connected in parallel and utilize a serial, full duplex communications protocol to communicate via a cable 124 with the control circuitry 24. The control panel circuitry is described in detail hereinafter with reference to FIG. 8.

Figure 5:
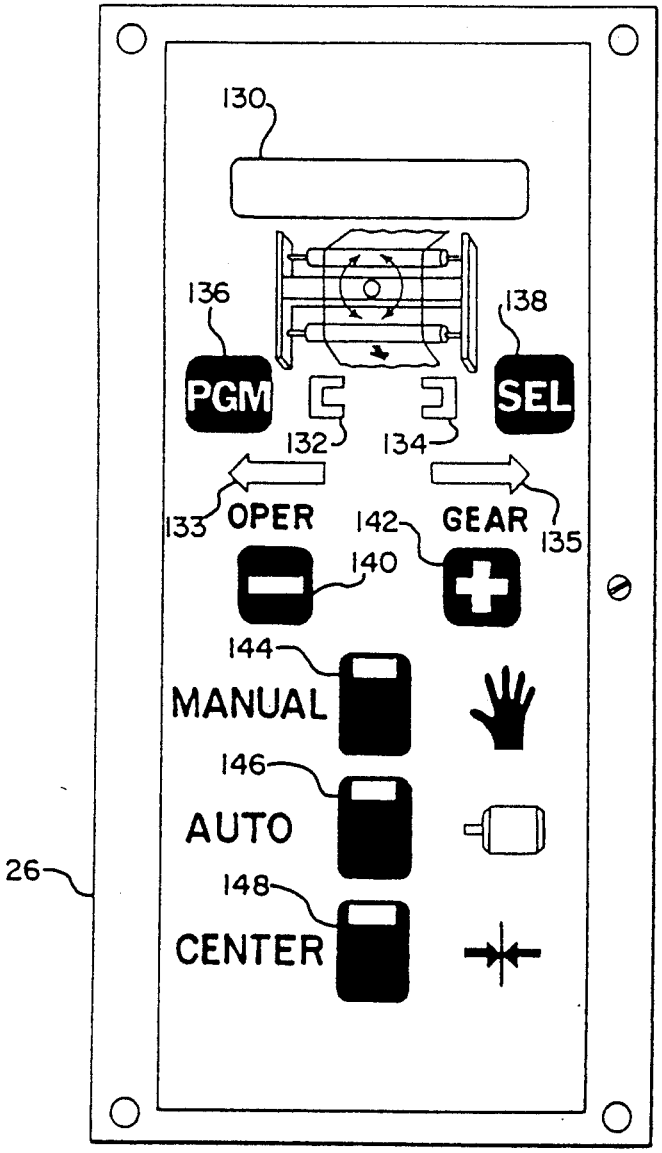
FIG. 5 is a front view illustration of a specific embodiment of the control panel shown in FIG. 1.
Figure 8:
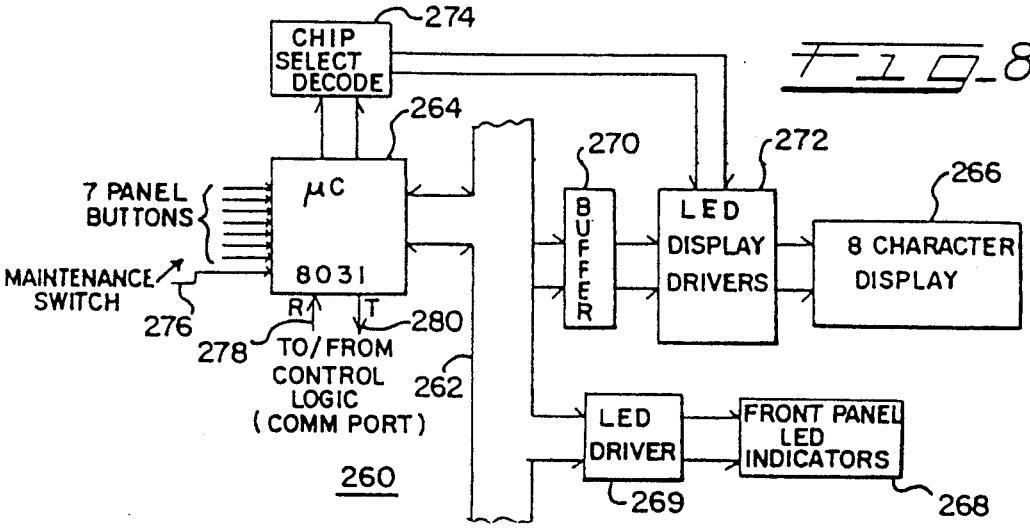
FIG. 8 is a detailed block diagram illustrating a specific embodiment of the circuitry for the control panel shown in FIG. 5.
Figure 9:
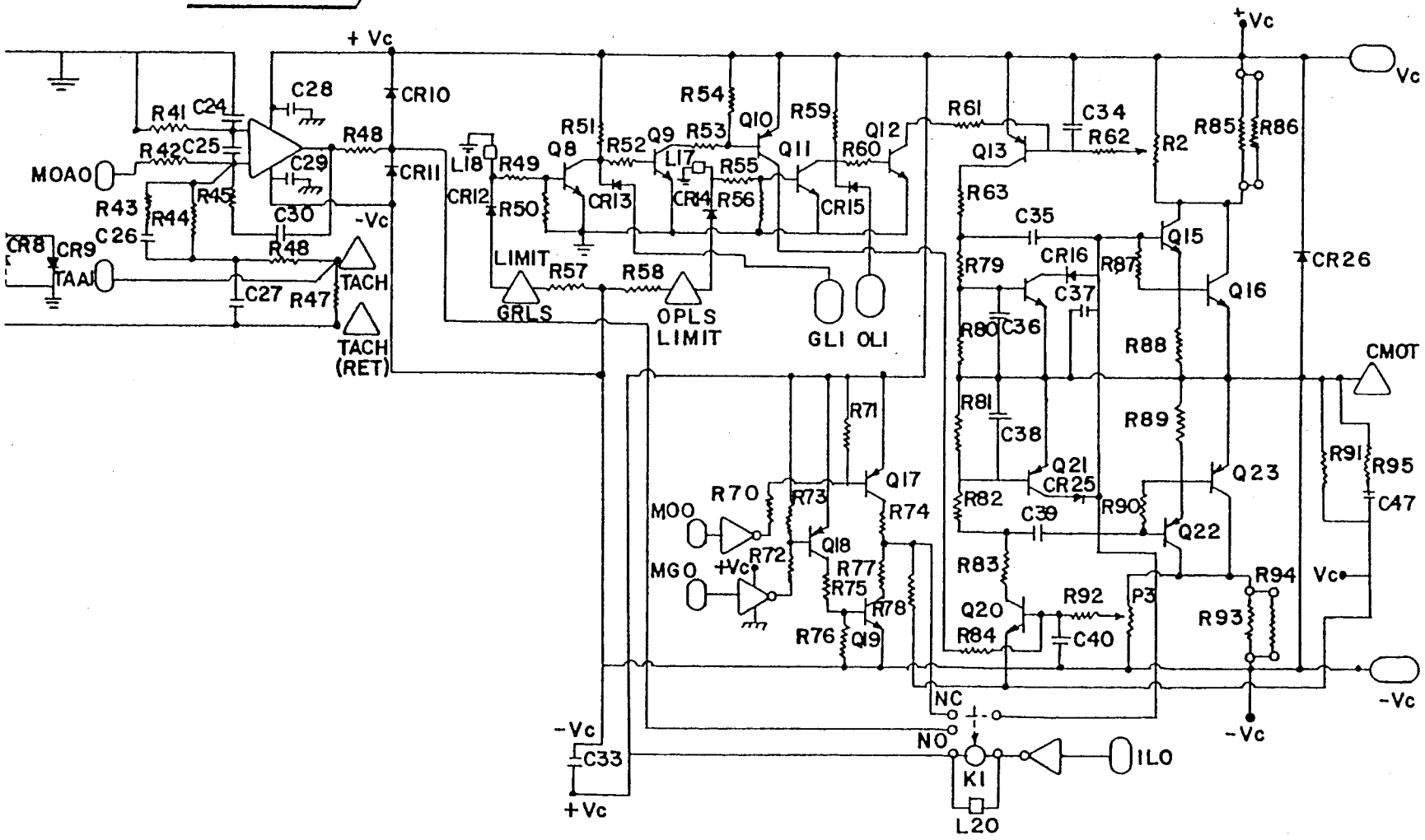
FIG. 9 is a schematic diagram of the correction motor control circuit shown in FIG. 7.

Referring now to FIG. 5, there is shown a detailed front view of the control panel 26 which operates in conjunction with the control panel circuitry shown in FIG. 8, the control circuitry shown in FIG. 7, and the edge sensors, end of travel sensor, limit switches, motors, and other devices that control the web guide assembly to perform the functional operation selected by the control panel 26. The control panel 26 includes an eight character alphanumeric readout display 130 capable of displaying or scrolling alphabetic or numeric characters. The control panel also includes guide mode indicators 132, 134, motor direction indicators 133, 135 and various panel keys. The panel keys include a program mode (PGM) key 136, a select (SEL) key 138, and operator correction (−) key 140, a gear correction (+) key 142, a manual mode key 144, an auto mode key 146, and a center mode key 148, as shown. Each of the Manual, Auto and Center keys has an associated indicator lamp (e.g., an LED in the illustrated embodiment), as shown, to indicate when the key is activated.

Although, typically the web guidance system 20 is operated to control the course of the web either automatically or manually, five primary functional modes of operation are available to the operator through the control panel. FIG. 6 is flow diagram illustrating the functional flow and methodology of a program for the microprocessor of the system control circuitry 24 in accordance with the invention, and illustrates the five primary functional modes. The five primary functional modes of the system operation are MANUAL, AUTO, CENTER, PROGRAM and MAINTENANCE modes. A program listing for the process illustrated in FIG. 6 for the control circuitry processor (Z-80) of the illustrated embodiment is provided in Appendix A attached hereto.

Referring to FIG. 6, the system upon power up initializes to default values stored in memory if the PZ switch is held on, and otherwise retains values set during previous operation, as illustrated at block 160. Also, as illustrated at block 160, upon power-up the system automatically enters the manual mode by branching to block 162, as shown. While in any mode, the system continually checks for panel key depressions to enable the system to respond to the control panel key selections made by the operator In the manual mode, the steering mechanism 50 pivot beam 52 may be moved using the operator correction key 140 and the gear correction key 142, as illustrated at block 164. Thus, the web can be shifted in the operator direction by use of the operator key 140 and in the gear direction by depressing the gear key 142. The readout during this mode will monitor and display the current steering beam tilt in a gear or operator percentage or will display "00 CNTR" for the condition in which the steering beam is perfectly centered, as illustrated by block 166. The message "LIMIT" will flash in the readout display 130 whenever an operator or gear tilt limit occurs and the corresponding correction indicator will also flash. This condition will remain until the steering beam is moved off of the limit. The manual mode may be selected while in any of the other modes, and the edge sensors will retract during the manual mode if they are not already fully retracted. As illustrated at block 168, the system checks for key closures to detect operator selection of another mode or tilt instruction.

The program mode (PGM) may be entered while in the manual mode or in the auto mode by branching program control to block 170. The program mode is used to select display and guide mode options and also to specify and program the web width and lap offset values that the operator desires to be used Upon entering the program mode at block 170, a "display mode" display will be scrolled across the readout 130 and either "TILT %" or "WEB POS" will appear displayed on the readout to indicate which display option was previously selected. The display mode desired is selected by depression of the selection (SEL) key 138. All depressions of the selection key will alternate the display between the two display mode options, thus displaying the available modes as indicated at block 172.

This permits the operator to chose between what information will be displayed in the auto mode operation. The manual mode displays tilt percent only. Tilt percent represents the rotational position of the steering mechanism in percent of maximum rotation while the web position option displays the position of the web within the scanners. The display mode is the only mode that can be entered and changed while running in the auto mode. If the display mode is entered from the auto mode, the auto mode can then be reentered by depressing the auto key.

If the program mode was entered from the manual mode, then a second depression of the PGM key 136 will implement the guide mode option. Once this mode is entered, as indicated at block 174, the display "GUIDE MODE" will scroll across the readout 130, and either "OP EDGE", "GR EDGE", or "CENTER" will be displayed to indicate which guide mode operation was previously selected. Depression of the SEL key 138 will rotate through these three guide mode options to permit selection of the desired option by the operator. These options tell the system which scanner will be used when running in the auto mode. The "OP EDGE" mode indicates that only the operator sensor 82 is the active sensor, the mode "GR EDGE" is the mode in which only the gear sensor 84 is active, and the mode "CENTER" is the mode in which both scanners are active. The sensor LED indicators 132 and 134 are lighted to indicate which guide mode option the system is using. In the various modes, the sensor that is turned off will remain retracted and will also not be checked for scanner fault conditions.

By depressing the PGM key 136 a third time, processing proceeds to access the web width selection mode as indicated at block 176. In this mode, the display "WEB WIDTH" will scroll across the readout 130 and a value in inches will be displayed indicating the web width previously selected. The operator key 140 and gear key 142 may then be used to decrease or increase, respectively, the displayed value in ⅛ inch increments. The gear key 142 will increase and the operator key 140 will decrease the web width value while a constant depression will speed up the value selection process. The exact width in inches of the web being used must be entered for proper operation of certain auto mode functions such as the "find and put" process of presetting scanner positions on initial starting conditions. However, if the auto mode function of "seek and hold" is used, then the web width does not need to be specified.

Upon a fourth depression of the PGM key 136, program flow proceeds to block 178 to the web offset value selection function where the message "WEB CENTERLINE TO PRESS CENTERLINE OFFSET" will scroll across the readout 130 and the value in a fraction of an inch increments (e.g., ⅛", 1/16", etc.) in either a gear or operator direction or a zero center indication will be displayed. This value represents the position of the desired web offset with respect to the centerline of the press. The web offset value must be correctly entered in order for the find and put operation to function, but is not necessary if the seek and hold mode of operation is used. The gear (+) key 142 will increase the offset value to the gear direction and the operator (−) key 140 will decrease the offset to the operator direction. Subsequent depression of the PGM key 136 will return control to the block 170 to permit rotating through the options and values again. At this point, the auto mode or the manual mode may be selected by depressing the auto key 146 or manual key 144. Throughout this mode, the processor continuously monitors the control panel for key depressions.

Upon completion of the sequence of selections in the program mode, program control may be branched to the auto mode illustrated at block 180 by depressing the auto mode key 146. The auto mode may be implemented using any one of two methods. A seek and hold method may be used when the press is already running above interlock speed when the auto key 146 is depressed. I this mode, the active edge sensor or sensors travel to the edge of the web while the message "SCANNERS SEEKING" is scrolled across the readout 130, as illustrated at block 182. When the edge sensors are locked on to the web, a message "LOCKED" will be displayed and flashed on the readout, as indicated at block 184. The system will then turn on the automatic correction and begin to compensate for any lateral error in the web, as indicated at block 186. The gear 135 and operator 133 indicator lamps (LEDs) will blink in response to the steering beam movements and the readout will display either tilt percent or web position depending upon which display was selected in the display mode during the program mode. These functions are performed to determine the web position by reading the edge sensors and determining the steering beam 52 movements by reading in the value from the tilt potentiometer 78, as indicated at block 188. As indicated at block 190, the processor continually monitors key closures on the control panel in order to respond to operator selections.

A second method of implementing the auto mode is the find and put method of auto mode operation which can occur when the auto mode is selected at a time when the press is below the interlock speed or not running. In this mode, the activated edge sensor or sensors will travel to within two inches of the edge of the web and stop while the readout 130 scrolls the message "WEB WIDTH" followed by a number and "OFFSET" followed by a number, and then scrolls "scanners presetting", as indicated at block 182. The readout 130 then flashes "ready" and the system waits for an indication that the press speed is above interlock from the interlock feedback signal at which time the scanner or scanners will move in to find the edge of the web. Once the web edge is found, a "locked" message will flash on the readout 130 as indicated at block 184 and the system then puts the web in the preset position designated by web width and offset values and maintains the automatic correction as indicated at block 186. Once the web is in the proper position on the web guide, the readout 130 displays the tilt percent or web position as selected in the display mode. The correction lights 133 and 135 are lit to provide an indication of steering beam movements. The web position and tilt percent values are obtained by reading in the sensor outputs and tilt potentiometer value as indicated at block 188.

Once one of the two methods of entering the auto mode is implemented the system can be left in the auto mode until the operator desires to stop the run or until parameters are changed. Upon emergency stops, such as web breaks and other times during which the press speed drops below the interlock speed, the web guide system 20 will scroll "below interlock" on the readout 130 and the sensors 82 and 84 will partially retract to two inches from the edge of the expected web position. Once this has occurred a message "ready" will then flash on the readout to indicate that the auto mode is still implemented and that compensation of the lateral motion can be resumed as soon as the press is brought back to operation. When in this condition due to an interlock dropout, the system 20, in one mode, will maintain in memory the position of the web and steering beam a predetermined time (e.g., 20 seconds) prior to the interlock dropout. When the press accelerates back up through the interlock speed, the sensors will begin to seek the edge of the web and the message "scanner seeking" will be scrolled across the readout 130. The previous web positions will be reestablished by the web guide after the sensor or sensors have relocated the web edge and have locked on and then the readout 130 will flash "locked". The system then continues to run in the auto mode, correcting for any lateral error and displaying either the tilt percent or web position values as selected. An alternative mode may be selected in which the steering mechanism is returned to a center position after the interlock drop out so that when the system is restarted it begins with the web guide aligned to a centered position.

Upon each entry of the auto mode, a self test of the edge sensors 86, 84 is performed to verify that the edge sensors are working correctly. The test is performed by automatically turning the infrared source 114 on and obtaining a full scale reading, then turning the source 114 off and testing for zero output of the detector 120. This test prevents a situation in which the sensor has its output jammed and the system then looks for a decrease which can't occur. In addition, a check for full scale calibration is made and if full scale output is below a threshold, a message "scanner fault clean scanners" is scrolled across the readout 130, and the system goes into manual mode. The operator would then have to clean the scanner before the auto mode could be activated. If there are three such failures to enter auto mode in sequence, a message "scanner fault, call maintenance" is generated. Finally, if full scale voltage from the scanner is not correct, but is more than the threshold, then an autocalibration is performed. The gain of the detector amplifier is modified to bring the output signal to full scale. In this way, compensation for a small amount of dirt on the edge sensor can be provided.

The center mode may be entered by depressing the center key 148 which branches process control to block 192. The center mode provides the capability for the main steering beam to be at its center rotational position. Upon selection of the center mode, the message "centering" is scrolled across the display 130 and the tilt potentiometer is read in to determine the position of the steering mechanism, as illustrated at block 194. The steering pivot beam 52 is then moved to the center position by activating the motor 62 as indicated at block 196. During the centering mode the system processor continually monitors for key-closures. The center mode may be interrupted at any time upon selection of the manual mode by depression of the manual key 144. When the centering function has been completed a message "centered" will flash on the readout 130 and the system, if configured to do so, will automatically return to manual mode. The auto mode, however, cannot be selected until the center mode has finished its centering function.

Upon system power up the system processor checks the PZ switch. If the PZ switch is depressed upon power up the system reinitializes all programmable parameters. If the PZ switch is not depressed on power up, these parameters will remain at the settings that existed on the previous operation.

A maintenance mode is provided so that an operator or maintenance personnel can change parameters and press variable data within the system. This mode is entered at block 200 by activating a internal switch located behind any one of the control panels 26, 28. The maintenance mode may be entered while in either the manual mode or in the auto mode. If entered while the auto mode is in progress, all auto mode functions will proceed normally although normal displays will be inhibited at the remote units involved. Once implemented, a message "maintenance mode" will scroll across the readout 130 and front panel keys become alternate function keys. In addition, all other remote stations connected to the same control circuitry 24 will display "REM * OFF" on the readout 130. This indicates to the operator that the front panel keys in the readout are disabled at that remote panel due to the maintenance mode being selected at one of the other control panels.

Once the system 20 is in the maintenance mode as indicated at block 200 of FIG. 6 and the other remotes are blocked out, three areas of maintenance operation may be selected using the PGM key 136. Once within a selected area of operation, variables to be programmed within each area are accessed using the SEL key 138. The three maintenance mode areas of operation are defined at the user variable area illustrated at block 202, the user switch area illustrated at block 204 and the address/data area illustrated at block 206. The user variable area is entered upon selection of the maintenance mode, the user switches area is selected by depressing the PGM key after entering the maintenance mode, and the address/data area is selected by depressing the PGM key a second time.

The variables within the user variable area which are selectable are accessed by successive depressions of the SEL key 138. The variables that can be controlled are the speed of the correction motor in the auto mode; the gain and offset of the operator edge sensor; the gain and offset of the gear edge sensor; the paster feedback caution trip point in the operator direction; the paster feedback caution trip point in the gear position; the pulse time on and wait time of the paster feedback signal; and the width between the edge sensors in both inches and any fractional component. The values corresponding to these variables are increased using the gear key 142 and decreased using the oper key 140.

The first variable which may be selected is the correction motor speed in the auto mode and the speed number is displayed on the display and is increased and decreased, if a change is desired, by using the oper and gear keys 140, 142. By depressing the select key 138 the operator may access the operator sensor gain which is the gain of the amplifiers which amplify the output signal of the edge sensor of the operator side. In this status the display will display the gain value and the value can be changed by using the oper and gear keys 140, 142. This permits the operator or maintenance personnel to increase the gain if the gain or output of the edge sensor is low. By depressing the select key 138 again the operator may access the operator edge sensor offset variable which permits the edge sensor offset gain to be changed. This value is a multiplier which is used to equalize the sensor signal input to the control circuitry to permit the signal levels to be maintained at a desired level. The next variables which may be selected is the gear scanner gain and the gear scanner offset which are comparable values to the operators scanner gain and offset discussed above.

The next variables which may be selected in order are the operator caution trip point for the paster feedback and the gear caution trip point for the paster feedback, which is entered in tilt percent. The paster feedback signal is a conventional feedback signal in web printing press systems which allows the system to adjust the press roll stand by generating a signal (paster feedback signal) which moves the roll stand slightly in the event that it is biased to one side. Thus, if the steering pivot beam is tilted beyond the caution trip point in one direction or the other a paster feedback signal is generated which moves the roll stand slightly to correct for the excessive bias in one direction. The next variable which may be selected is the pulse on time for the paster feedback signal which determines how much movement of the roll stand is accomplished when a paster feedback signal is generated. The next variable which may be selected is the wait time for the paster feedback signal which is the amount of time which the system will disable the paster feedback pulse before another pulse can be generated. This is the time needed to permit a determination of the result of the previous paster feedback signal.

To switch to the second area of operation of the maintenance mode illustrated by block 204 of FIG. 6, the user switch area, a depression of the PGM key 136 is utilized. The various switch selections within this area are also accessed by successive depressions of the SEL key 138 and the user selects a state of either on or off for each switch condition. These conditions include center mode to manual mode inhibit; interlock ignore in auto mode, edge sensor retract inhibit on interlock out, edge sensor permanent position enable, edge sensor retract upon power-up inhibit, edge sensor web tracking with servo system off enable, auto center potentiometer automatic gain calibration enable, and disabling of the centering of the main steering beam on interlock out. To set the switches to their desired state the operator depresses the gear key 142 for the ON state and depresses the oper key 140 for the OFF condition.

The first switch selection available upon entering the user switch area is the center mode to manual mode inhibit. When this switch setting is ON the center mode will not exit to the manual mode automatically, while if it is set in OFF center mode will automatically exit to the manual mode when completed. The next switch option is selected by depressing the SEL key 138 (as are all subsequent switch selections) and is the interlock ignore with the auto mode on. If this switch is set in the ON condition the interlock dropout will be ignored in the auto mode, and if OFF the interlock dropout in the auto mode will result in stopping correction and withdrawal of the edge sensors as described hereinbefore. The next switch selection is the edge sensor retract inhibit in which the ON condition results in the edge sensors retracting on an interlock dropout, while the OFF condition results in no retraction of the edge sensors upon interlock dropout. The next switch selection allows the edge sensors to stay in position and ignore the interlock dropout if in the ON position, and if set to OFF, the edge sensors will locate two inches from the web after interlock dropout and wait for the interlock to return. The next switch selection, if in the ON position, results in the edge sensors going to two inches from the web upon interlock dropout and waiting for interlock return, and then upon interlock return the scanners go to the predetermined web position automatically without searching for the web. If the switch is set to OFF, the scanners will go to the two inch position upon interlock dropout, and then after the interlock returns will search for the web and move the edge sensors to the detected position of the web.

The next switch selection if in the ON position causes the edge sensors to not retract when going through the sequence from the auto mode to the manual mode to power off then back to power on and back to auto mode. If this switch is set in the OFF position then normal operation will occur in which the scanners retract when power is turned off. Thus, in the ON position the switch allows the system to be turned off and then on again from the auto mode back into the auto mode without the scanners retracting. This switch setting resets to OFF after one cycle of operation. The next switch setting when set to ON causes the edge sensors to track to web edge only when in the auto mode but disables the servo system, and when set to OFF operates the auto mode in normal operation.

The next switch selection when set to ON provides a center mode automatic gain calibration of the steering mechanism. This automatic calibration mode causes the system to cycle the steering pivot beam 52 to each extreme of angular development (tilt) and measures the output of the steering beam tilt potentiometer 78 thereby permitting self calibration of the tilt potentiometer 78 after which the steering beam returns to center. In the OFF setting the center mode will simply follow normal operation as described hereinbefore. This calibration mode allows an automatic calibration of the tilt potentiometer so that the system can insure that a reading of 99% tilt occurs just before the limit switch is activated. This feature permits accurate setting of caution trip points to be used to activate a paster feedback signal when the steering pivot beam angular displacement exceeds the caution trip points. The last switch setting if in the ON position disables centering of the steering pivot beam 52 upon interlock dropout when in the auto mode and maintains the steering pivot beam 52 at the position it was at when the interlock dropout occurred. If the switch is put into the OFF state then normal operation will occur wherein the main beam will center upon an interlock dropout. Another option which may be provided is that instead of the steering pivot beam 52 centering upon interlock dropout the steering pivot beam 52 will return to the position it was at a predetermined time (e.g., 20 sec.) prior to the interlock dropout instead of returning to center.

The third area which may be accessed by an additional depression of the PGM key 136 is the address-/data area indicated at block 206. This area of operation permits the user to enter a four digit address location ranging from 4828 to 4851 in hexadecimal and includes the ability to specify a two digit hexadecimal data number for each of these locations. Thus, it permits the operator to address memory locations in the system RAM and then enter new data into that location. In this mode, the manual key 144 and auto key 146 function as cursor movements for which digit positions on the readout 130 are manipulated. Thus, the manual key 144 moves the cursor to the right and the auto key 146 moves the cursor to the left. The desired digit position to be changed will blink. To implement the data and address location displayed in the readout, depression of the SEL key 138 is required. Successive depressions of the PGM key 136 will rotate back through the three areas indicated at blocks 102, 104 and 106.

The operator may exit the maintenance mode at any time by turning off the maintenance mode switch. The system 20 will return to the mode that it was in prior to entering the maintenance mode and other remotes will change the readout from "REM*OFF" to the normal display for the mode being re-entered. The mode in progress will proceed until input from the operator changes the mode.

Referring to FIG. 7, there is shown a detailed block diagram illustrating a specific embodiment of the control circuitry 24 utilizing a microprocessor 210 (e.g., a Z-80 in the illustrated embodiment) to provide control processing. The programming for the microprocessor 210 is stored in a program memory 212 comprising a programmable read only memory (PROM) coupled to the processor 210 via a bus 214, as shown. The microprocessor 210 is coupled to support peripheral circuitry via a main bus 216.

Coupled to the microprocessor 210 via the bus 216 is an input port interface 218 having an interlock signal input, a gear limit switch input 298, an operator limit switch input 296, an operator end of travel input and gear end of travel input, as shown. A stepper motor controller and driver 220 is coupled to the microprocessor 210 via the bus 216 having drive outputs for the operator edge sensor motor and for the gear edge sensor motor. An output port interface 222 provides an output interface with outputs to the operator paster feedback relay and the gear paster feedback relay, as well as the manual move signals 292, 294 for both the operator and gear side and an interlock signal 290. A timer/counter circuit 224 is coupled to the bus 216 and includes a clock 226 coupled thereto. A signal from the clock 226 is coupled to the infrared LEDs 228 to provide the two kilohertz modulation signal to the edge sensor infrared generating LEDs. A random access memory 230 (RAM) which serves as a data memory for storage of operational data for the microprocessor 210 is coupled to the bus 216, as shown. An analog to digital (A/D) converter 232 is coupled to the bus 216 directly as well as through a chip select decoder 234 which provides select signals to the A/D converter under the control of the microprocessor 210. An analog multiplexer 236 provides a multiplexed input to the A/D converter permitting the tilt potentiometer, tachometer, operator scan sensor, and gear scan sensor inputs to be multiplexed into the A/D converter.

Also coupled to the microprocessor 210 via the bus 216 is a dual channel UART communications port 240 which provides full duplex serial communications with the remote control panels 26 via a transmit and a receive line, as shown. In addition, the communications port provides for the input of the PZ switch input as well as an auxiliary data communications port 242, as shown. In addition, a series of multiplier circuits 244, 246, 248 are coupled to the microprocessor 210 via the bus 216. The multiplier 244 permits a microprocessor controlled multiplication of the gear edge sensor signal, and the multiplier 246 permits a similar multiplication of the operator edge sensor signal. The output signals from these two multipliers 244, 246 is differenced in a differential amplifier 247 and coupled to the third multiplier 248, the output of which is coupled directly to a motor control circuit 250 via conductor 304, as shown. This multiplier structure permits the microprocessor 210 to control the gain of the sensor amplification channels. Also coupled to the motor control circuit 250 are the operator limit switch signal 306, gear limit switch signals 308, the interlock signal 290, the correction motor tachometer signal 302, the manual move signals 292, 294 for both the gear and operator side, and gear and operator limit signals 298, 296, as shown. The output of the motor control circuit 250 is the correction motor servo signal, which is used to drive the steering pivot beam 52. The motor control circuit 250 is shown in detail in the schematic diagram of FIG. 9.

In operation, the motor control circuit 250 utilizes the input signal from the multiplier 248 to control the servo motor. The signal from the multiplier 248 is a modified signal from the edge sensors which has had the signal from the edge sensors adjusted in gained by the multipliers 246 and 244, after which the difference between the two is obtained via the differential amplifier 247, and then the resulting offset error voltage is amplified by the multiplier 248 and coupled to the motor control 250. This error voltage is used by the circuitry 252 in closed loop with the tachometer value from the correction motor. The gain of the amplifier is controlled by the value of the motor speed variable which is set within the maintenance mode. The motor control circuit is thus always attempting to drive the correction motor from the error voltage detected. The tachometer value in the motor is fed back to the motor control circuit in closed loop from the correction motor. The speed of the tachometer thus makes the motor control change its output voltage by speeding up or slowing down until a balance between the error voltage and the feedback voltage is obtained. This results in a speed of correction which effects the movement of the steering mechanism in the direction opposite the error, resulting in a change in the error voltage which approaches zero caused by moving the web back to the zero position in the edge sensor.

As can be seen from inspection of the control circuit 24, the tilt potentiometer input signal is required for correct operation of the system. This potentiometer monitors the relative position of the steering pivot beam for functions such as center mode and tilt percent display modes. The signal from this potentiometer is processed so that the error voltage is the rotational deviation from the zero point of the potentiometer. In the center mode, this signal becomes closed loop with the motor tachometer feedback circuitry.

FIG. 8 is a detailed block diagram illustrating a specific embodiment of the control panel circuitry 260, including a control microcomputer (e.g., an 8031) coupled to a main bus 262, as shown. Coupled to the microcomputer 264 via the main bus 262 is the eight character display 266 and the front panel LED indicators 268. The front panel LED indicators are coupled to the bus 262 through a LED driver 269, as shown. The eight character display 266 is coupled to the microcomputer 264 via the bus 262 through a buffer circuit 270 and an LED display driver circuit 272, as shown. Also coupled to the LED display driver 272 is a chip select decode circuit 274, which is coupled directly to the microcomputer 264, as shown. In addition, the seven panel control keys are coupled directly to inputs of the microcomputer 262, as well as a direct input from the maintenance switch 276, as shown. A program listing for a program to operate the processor (8031) of the illustrated embodiment is provided in Appendix B.

The control panel circuitry 260 communicates directly with the control circuitry 24 through the communications port 240 of FIG. 7 via receiving line 278 and transmit line 280. A communications between the control circuitry 24 and the control panel circuitry 260 is serial communication using a serial protocol wherein multiple control panels may be coupled in parallel to the control circuitry 24.

The serial protocol uses a twelve byte block to transmit data with each byte composed of an eleven bit byte. Each message block is composed of a beginning byte, ten message bytes and an end byte. The remote first detects the beginning byte which alerts it to the arrival of a message after which the next eight bytes contain message information followed by a ninth byte which holds the LED display values and a tenth byte, the maintenance byte, which informs the remote if the system is in the maintenance mode. Each closure of a key is transmitted from the control panel to the control circuitry five times and the control circuitry counts the transmissions to verify a true key closure. Each byte is composed of a start bit followed by eight data bits, a parity bit and a stop bit. This serial protocol provides for reliable transmission, together with the capability for multiple remote control panels.

Specific embodiments of novel methods and apparatus for automatic web guidance has been described for the purposes of illustrating the manner in which the invention may be used and made. It should be understood that the implementation of other variations and modifications of the invention in its various aspects will be apparent to those skilled in art, and that the invention is not limited by the specific embodiments described. It is therefore contemplated to cover by the present invention any and all modifications, variations, or equivalents that fall within true spirit and scope of the basic underlying principles disclosed and claimed herein.

APPENDIX A

```
:0F0000000100003E4B10FE0D20FB3D20F81B6163
:03000800C36900C9
:03001000C36900C1
:03001B00C36900B9
:03002000C36900B1
:03002B00C36900A9
:03003000C30308FF
:03003B00C3690099
:10006600C369002A004323220043F3ED56C3000868
:03007600180100 6E
:06080000C3080C32A101F
:0508060000000000000ED
:10080B00F3ED56315E40CDDD0FCD1D09CDFF0BCD88
:10081B00AC1006012100FEDB10E601200E237CB597
:10082B0020F510F03E01CDDC0D1B2006012100FE55
:10083B00DB10E60128152 37CB520F510F03E01CD29
:10084B00DC0D2A0E4523220E451B00C30C103E0169
:10085B00D310F3ED560E00DB10E601203C0C060125
:10086B0021C0FFDB10E601201DE5C5CD680BCD9443
:10087B001DC1E1237D9420EB10E63E01CDDC0D3E26
:10088B007832084518443A0845A7280B3D320845F0
:10089B0020021B003E01CDC50DCD3D0FCD2B0FCD48
:1008AB004F0F060121C0FFDB10E601281BE5C5CD6F
:1008B3006B0BCD941DC1E1237DB520EB10E63E0105
:1008CB00CDDC0D1B053E01CDC50D3E80D310C356B2
:0408DB0008F71BFD05
:1008DF0006501C100FBE1DE91E831BF814000000EC
:1008EF0000C2409A4012413A4162418A41000000E1
:1008FF00000101010101010000010101010201 00DC
:09090F0000000000000000000DF
:05091B000000000000DA
```

```
:10091D00AF322B453E04324E42DBB4E604C03EFF2F
:10092D003228452100421101423600001FE05EDB08A
:10093D0021004B110148360001FE17EDB021100BC2
:10094D0011004801530 0EDB0212848222546110021
:10095D004821020B06057EB728064F1AED791323A1
:10096D0010F43E04322146D3A83E02322046210720
:10097D000B224B423E09324D423E05324E423E461F
:10098D001E05CDE10C2277463E461E05CDE10C221B
:10099D002C463EFF322B453A094811E803CDF10CA8
:1009AD001600226046ED5362463A0A4811401FCDAB
:1009BD00F10C6C63110000224546ED53474611457D
:1009CD0046216046CD840D2A6046ED5B6246CB3AEA
:1009DD00CB1BCB1CCB1D224546ED5347463A404819
:1009ED0011F401CDF10C160022494 6ED534B462171
:1009FD0000000224F462A4148CB3CCB1D224D4611CB
:100A0D004D46214946CD840D1149462145 46CD8F90
:100A1D000D2A454611E803CD440D7DB728013D3221
:100A2D006446473A434BCB7F2006BB380B78180800
:100A3D00ED46B8380378ED4432434BCB7F2802EDBE
:100A4D004411E803CDF10CED5B4448CB7A2807E562
:100A5D00210000ED52D1191100002 24D46ED534FEA
:100A6D0046214946114546CDAB0D2151461145460E
:100A7D00CDAB0D214546114D46CD840D2149461175
:100A8D004D46CD8F0DED5B454621A983CD190D3A10
:100A9D0047468728 06EB01A98309EBED534546ED13
:100AAD005B494621A983CD190D3A4B46872806EB74
:100ABD0001A98309EB2A45463A434847 3A4548B0D0
:100ACD00CB7F2809ED533B46223D461B07223B4676
:100ADD00ED533D46ED5B514621A983CD190D3A539A
:100AED0046B7EB280401A9830911F40119CB25CBD5
:100AFD0014223F46C9A4A0A1A2A3535953544 54D56
:0E0B0D002050DA55AAA5AAA5202040402931 83
:020B30001400AF
:100B380002383804000004401E103C0300BB0200C9
:100B48003C1405041B6340012600000000000 10064C
:0B0B5800FF0504280502060 40A807057
:050B63000000000000BD
:100B68003A0745CB7F203D2A0045EB3A0745E67F0B
:100B7B0032003C2A02453A0445 86320445AF320029
:100B8B003C231B7AB32B021B423A0445A7C2340C06
:100B9B003E02CDC50D3A0545F53A400C57F1BAFA73
:100BA800050C1B532A0045EB2A02453A0745E67F0B
:100BB80032003C4EAF77BE201A3EFF77BEC2DB0B39
:100BC80071AF32003C231B7AB328 1F220245EB2267
:100BD8000045C971AF32003CE5D53E0432 0445CD2D
:100BE800DC0D3A05453DD1E118AE3A0445A720A5EC
:100BF8003E04CDC50D189E3E0132400CAF5F160075
:100C08003C3205457BCB23835F2141 0C191E0056DE
:100C1B0023EB220245EB1E0056237AB7CA9D0BEB45
```

```
:100C2800220045 1A320745AF320445C93E02CDDCE1
:100C3800D3A05453DC3A008094040800010001047
:100C4800100020100080200 0A02000C0200080207C
:040C580001A02001D6
:100C5C00CDC50CF57BCDC70C5FF1C5CDE10CC10C3E
:100C6C00C0D5EB210000A7ED52D1C9CDC50CCDCF1D
:100C7C000CC5CDF10CC10CCOCD6DOC3E009B5FC9F9
:100C8C00CDC50CEBCDCF0CEBC5CD410DC36A0CCD56
:100C9C00CDOCEBCDCF0CEBC5CD190DC10CC0CD6D72
:100CAC000CE5210000ED52EBE1C9CDCDOCEBCDCF25
:100CBC000CEBC5CD440DC36A0C0EFEA7F0ED440C35
:100CCC00C90EFEF57AA7F2DF0CE5210000A7ED5264
:100CDC00EBE10CF1C91600210000CB3F300119EB00
:100CEC0029EB20F6C926006C4C44CB3FF53006A707
:100CFC00ED5A79884FEBA7ED6AEB7B3F47F120EA34
:100D0C0059C9E5CDF10CC1A7ED4AD01CC901000081
:100D1C00C5D9D1626AD9CB3ACB1B300DE5D9C109D3
:100D2C00D9C5D9C1EBED4AEBD9ED6ACB11CB107B10
:100D3C00B220E3D9C95F16007BB2CA7D0D01010058
:100D4C007AA7FA5B0DCB21CB10CB23CB121BF1E594
:100D5C00210000E3E5A7ED52DA6D0DE3E1E309E3D1
:100D6C00E5E1CB3ACB1BCB3BCB197BB120E6EBE1E4
:080D7C00C921FFFF11FFFFC9AF
:100D840000604B71A8E77231310F9C90604E5C521A2
:100D940009450E01B71A2F8977 0E00132310F6C1E7
:100DA400E111094530DAC906041A77132310FAC9B8
:0E0DB400E15E2356876F2600195E2356EBE999
:030DC2001B01FF16
:100DC5003A1145B72805 3D321145C0210D45CDF6EF
:100DD5000D7B2F4EA677C9CDF60D210D453A104554
:100DE500A0A8B6773EFF3211452A0E4523220E45AF
:0A0DF500C906013DF8C8CB201BF92B
:050DFF000000000000EF
:100E0400DB89CB47201C3A07433D320743B7C03246
:100E140003433A4F42FE68C04F3E00324F42C39DE7
:100E24000EC93A2E48320743DB8B4F3A4F42FE68D5
:100E340020083E00324F42C3080F3AFF0DFEFF2048
:100E44000D3E0032FF0DDD210050DD22000E3AFF81
:100E54000D3C32FF0DD5ED5B000E791213ED5300FE
:100E64000ED13A0543B92B1779320543FE682007A5
:100E74003E0432044 3B7C93A2D4B320443B7C93A51
:100E84000443 3D320443B7C03E0132044379FE6853
:100E94002007324F42320443C979FE4820073A50B2
:100EA40042FE01205F79E660FE6028073E00325072
:100EB4004218053E01325042 3A0343B9202E3A0209
:100EC400433D3202432 03D3A45423202 43473A44CD
:100ED400423D32444220273A5048B8F2020F7BCBC0
:100EE4003F3245423A4B42324442 1B123A4642326C
```

```
:100EF40002433A4742324542 3A48423244427932 06
:060F040003433 7C9B7C921
:050F0A0000000000000E2
:100F0F00F7CD040E30FAE67F1E41BB3BF31E69BBE6
:070F1F0030EE3249421BE9EF
:050F260000000000000C6
:100F280021A90F7E23474E235E2356231AED7910FA
:100F3B00F5C921C50F7E23474E235E235623ED7B3B
:100F4B001210F5C921214535F036753A0643EE10DE
:100F5B00E61032064 3D3EC212345112245060 80E39
:100F6B00FE7EA728063520031AA11223CB0110F110
:100F7B00C9E17E23A72001E94F06005E235623D546
:100F8B005E235623E3EDB01BEBE37E23A72002D1BE
:100F9B00E94F06005E235623E3EDB0C3940F031114
:100FAB0000471201471302470000000000000000039
:100FB3000000000000000000000000310034712043 3
:0D0FCB0047130547000000000000000000073
:050FD800000000000014
:100FDD003A2F483246423A3048324742 3A31483247
:100FED0048423E00324F42CD521D3E10D38A3E053F
:0F0FFD00D38A3E43D3883E07D3883E88D389C921
:10100C003E28D3E3EFFD3E8D3E8AF320944320A83
:10101C00443E80D310DD210B443ADF08185DAF321B
:10102C00003CED7302442A0244ED7B0044DDE1DD1B
:10103C007500DD74013E0BD3EBDBEB5FDBE857217C
:10104C00FFFFB7ED52ED5B0944220944B7ED52DDC9
:10105C007530DD743111007FB7ED52FA6B10003A28
:10106C003042DD77203A0444DD23DD233D200CAFF4
:10107C00D310323042320003CC35908DD351020E821
:10108C00320444DD7E11DD7710DDE5ED730044DDC7
:10109C006E00DD6601F9DD7E2032304232003CC943
:10104C00ED7305443ADF0847DD21F008FD21E00827
:10108C00110B44DD6E00DD23DD6600DD23F9FD6ED2
:10100C0000FD23FD6600FD23E5ED7307442A07446C
:10100C007D12137C121310D83ADF0847DD21000967
:10100C00FD210809111B44DD7E00DD231213FD7E5A
:10100C0000FD23121310F03ADF0847DD211009110F
:10110C002B44DD7E00DD2312131310F6ED7B05441A
:01111C00C909
:06111D000000000000000CC
:10112300 3E03323146F7F73E30320047F73E3F3257
:10113300047F73A2848D315D319F7F73A2948D384
:10114300 14D31BF7F73A2A48D314D318F7F73A28DE
:10115300 48D314D31BF7F73A2C48D314D31B0632CC
:10116300C5F7C110FB3A2048C86F20163E4ED3156E
:10117300D319AF6F6722324622344 6AF3236463236
:10118300 3746AF323146C93A3146CB472803F71BC1
:10119300F63A3146F6D1323146CD3D13CD9F143E2A
:1011A3004 8D315AF32364621FFFFE51B5E3A3146B1
```

```
:10118300CB4F2803F718F63A3146F602323146CDC3
:1011C3004413CDB7143E4BD319AF32374621FFFFDB
:1011D300E5C363123A3146CB472803F718F63A3191
:1011E30046F601323146E5CD3D13E1E53EFFBD2034
:1011F30003BC2808ED5B3246192232 46E12BE5CDC9
:101203009F143E43D3153E01323646CD9F14E1E58C
:101213007DD314CD9F14E17CD314CD9F14AFD3148D
:101223003A3146CB8732314 6C93A3146CB4F280350
:10123300F718F63A3146F602323146E5CDA413E10A
:10124300E53EFFBD2003BC2808ED5B3446192234 79
:1012530046E12BE5CDB7143E43D3193E0132374661
:10126300CDB714E1E57DD318CDB714E17CD318CD08
:10127300B714AFD3183A3146CB8F323146C93A311E
:10128300 46CB472803F718F63A3146F601323146B2
:10129300CDE914C43D133E42D3152A32462322 32EC
:1012A300463E01323646C323123A3146CB4F28031A
:1012B300F718F63A3146F602323146CDEE14C4A49D
:1012C300133E42D3192A3446232234463E01323791
:1012D30046C378123A3146CB472803F718F63A311A
:1012E30046F601323146CDE914C43D133E4AD315C7
:1012F3002A3246 2B223246AF323646C323123A31C4
:1013030046CB4F2803F718F63A3146F602323146FB
:10131300CDEE14C4A4133E4AD3192A3446 2B2234E7
:1013230046AF323746C378123A3146CB472803F7E4
:101333001BF63A3146F601323146CDE91428 3FCD4D
:101343009F143E41D315CD9F14CDE91420FB3EB35D
:10135300D315CDC514DB145FD5CDC514DB14D1571C
:10136300D5CDC514DB143A3646CB47E1232807EB2A
:1013730021000 0B7ED52ED5B3246192232463A03A3
:1013830047CB5FCA2312210000223246C323123AFD
:101393003146CB4F2803F718F63A3146F602323 17D
:1013A30046CDEE14283FCDB7143E41D319CDB71423
:1013B300CDEE1420FB3EB3D319CDD714DB185FD5B7
:1013C300CDD714DB18D157D5CDD714DB183A374610
:1013D300CB47E1232B07EB210000B7ED52ED5B3447
:1013E3004619223446 3A0347CB67CA7812210000D4
:1013F300223446C378123A3146CB472803F718F60E
:101403003A3146F601323146CD3D132A3246ED5B81
:101413003A48ED523007ED5832462100002232 4656
:101423001BED534546CD9F143E43D315CD9F143A28
:101433004546D314CD9F143A4646D314CD9F14AFDB
:10144300D314AF323646C323123A3146CB4F280367
:10145300F718F63A3146F602323146CDA4132A3450
:10146300 46ED5B3A48ED523007ED5B3446210000 10
:101473002234461BED534546CDB7143E4BD319CD0D
:10148300B7143A4546D318CDB7143A4646D318CDC8
:10149300B714AFD318AF323746C378120600C5F777
:1014A300C1DB15CB4FC810F63E02323846 3A010075
```

```
:1014B300321B46C90600C5F7C1DB19CB4FCB10F66E
:1014C30018E60600C5F7C1DB15CB5720F7CB47C09D
:1014D30010F218D40600C5F7C1DB19CB5720F7CBA0
:1014E30047C010F218C2DB15CB57C9DB19CB57C95C
:0514F3000000000000F4
:1014F800AF323846323946F73A3846CB4F283BAFF9
:1015080032394632384630147E6EF3201473A2047
:10151B0048CB6F2006CD3A11CDB011AF3268462A6C
:1015280051482269463A5F46CB7F28021B0BB72BF7
:10153800009E60F322146AF325F46068B3A2046FE5A
:10154800022B070608B728020680 3A3946A0BB20BC
:10155B001A3A3846CBFF323946 3A3A46B7200C2A70
:10156800324622414624344622463462A1D462B2229
:10157B001D46CB453A3946 23FCB3FCB3FCB3FCB17
:10158B003FE607CDB40DA515E607CDB40D9715B305
:10159B00152217D7172819E019341A601BB3157C40
:1015A800175018961907 1AB41A601B3A3846CB47D1
:1015B800C20116AF326546CDE514C2FF14CDEE1450
:1015C800C2FF143A6846B720202A69462B2269468A
:1015D8097DB4C2FF142114 00CDD7112114 00CD2CE5
:1015E800123E01326846C3FF14CD2311AF3268465C
:1015F8002A5148226946C3FF143A3A46B73A39484D
:10160800200033A4B48322F46323046 3A2048E642C9
:10161B00200DCB6FC257193A0347CB6FC2AC163AAD
:10162800204 8E61823473A3A46B72B413E663229F4
:10163800463A2146CB4F2017CD2B132A4146ED5B66
:10164800 3246B7ED522B053B03CDD7113A2146CB9B
:10165800 47C2FF14CD92132A4346ED5B3446B7EDDB
:10166800 52CAFF14DAFF14CD2C12C3FF143E1132F4
:10167800 39463A3846CB8732334 62A3748221D46FB
:10168800 3A2146CB4F200CCD2B1321FFFFCDD7118C
:10169800 3A2146CB47C2FF14CD921321FFFFCD2C30
:1016A800 12C3FF143A3A46FE01C2FF143A6546CB0C
:1016B800 47C2FF14CBC7326546 3A2146CB4F202894
:1016C800CD2B132A4146ED5B3246B7ED522816382A
:1016D800143A204BCB5F200AED5B3A4BED522805C2
:1016E800 3803CDD7113A2146CB47C2FF14CD921308
:1016F800 2A4346ED5B344AB7ED52CAFF14DAFF144D
:10170800 3A204BCB5FC21C17ED5B3A4BED52CAFF3E
:10171800 14DAFF14CD2C12C3FF143A204BE64220F5
:10172800 083A0347CB6FC22B1A3A1E46FE00201C0C
:10173800 3A1D46FE0020153A3846CBF7323846CDDA
:10174800 8A11CDB011AF323946C3FF143A2146CBC6
:10175800 4FC2411BE6F0FE40C2411BD3A600DBA6EE
:10176800 EEB0CB7FC2411B3A3946C323946CD2B00
:10177800 13C341183A204BE642200B3A0347CB6FB2
:10178800 C22B1A3A1E46FE00201C3A1D46FE0020B7
:10179800 153A3846CBF7323846CDBA11CDB011AF5D
:1017A800 323946C3FF143A2146CB47C2BA18E6F08D
```

```
:1017B800FE50C2BA18D3A600DBA6EEB0CB7FC2BA11
:1017C8001B3A3946C6103239 46CD9213C3BA183A7B
:1017D8002048E642200B3A0347CB6FC22B1A3A2129
:1017E8004 6CB4FC2411BE6F0FE40C2411BD3A600CE
:1017F800DBA6EEB047CB7F2B02ED444F3A2048CB4A
:1018080077202 33A3A46B73A4C4820033A4D48B92C
:1018180 0DA2E183A2F463D322F46200A3A3946CB5F
:1018280 0DF3239461B133A3648B9D2411BCB7B20F6
:1018380005CDD7121803CD81123A2146E60FF6508E
:1018480032214 6D3A8C3FF143A2048E642200B3A7A
:1018580000347CB6FC22B1A3A2146CB47C2BA18E6C8
:1018680 0F0FE50C2BA18D3A600DBA6EEB047CB7FA5
:1018780 02B02ED444F3A2048CB7720233A3A46B71E
:1018880 03A4C4820033A4D4 9B9DAA71B3A30463D51
:1018980 0323046200A3A3946CBFF3239461B133AD5
:1018A800364 8B9D2BA18CB782005CD01131B03CD24
:1018B800AC123A2146E60FF640322146D3A83A3810
:1018C80046CB7FCAFF143A2146E60FFE0420433A6E
:1018D8003A46CB4726 3C2A3246ED5B3B46ED52EB75
:1018E8002A3446ED4B3D46B7ED4219CB7C2806EB32
:1018F8002100 00ED52ED5B4949B7ED5238143E1017
:1019080032 3946AF3239463A0147E6EF320147C32B
:1019180 0FF143A3A46B728373E3332394 6C3691975
:1019280 3A2048E642200B3A0347CB6FC22B1A3A8E
:1019380 02146CB4F200C2A3246ED5B4146B7ED528B
:1019480 0202F3A3946CBDF323946CB7FCAFF143EC7
:1019580 0903238463E4432394 63A2048CBAF3220AE
:1019680 0483A2146D3A83A0147F610320147C3FF47
:1019780 014CB7C3A0347200BE602C2FF14CDD712E2
:1019880 0C3FF14E604C2FF14CD8112C3FF143A202A
:1019980 04BE642200B3A0347CB6FC22B1A3A214641
:1019A800CB47200C2A3246ED5B4346B7ED52200B5B
:1019B8003A3946CBFF323946C3FF14CB7C3A03474A
:1019C800200BE604C2FF14CD0113C3FF14E602C2C4
:1019D800FF14CDAC12C3FF143A2048CB4F20083A6D
:1019E8000347CB6FC2171A3A2146CB4FC2FF142ABE
:1019F8003246ED5B4146B7ED52C27919C3FF143A3E
:101AC8002046CB4FC29C1A3A0347CB6FCA9C1A3A5C
:101A18003A46CBFF323A462A3246224146 2A3446D3
:101A28002243463A0147E65F3201473A2048CB5F66
:101A3800C2621A3A2146CB4FCC2B133A2146CB47EB
:101A4800CC92133A2048CB5728103A2146CB4FCC9A
:101A5800F9133A2146CB47CC4C143E553239463E11
:101A6800203238463A2148CB4728083A0147E6EF5F
:101A7800320147C3FF143EFFD3A43A2146325F46E2
:101A8800 3C67322146D3A33A0147E603F6103201F1
:101A9800 47C3FF143A2146CB47C2FF142A3446ED08
:101AA800 5B4346B7ED52C2C319C3FF143A5F46CB36
```

```
:101A8B007F202FB728463A2146FE67C2FD1AD3A6D3
:101ACB0000DBA6EEB0202E3A5F46322146 3A0048D7
:101ADB00D3A43A0147E6EF3201473E6A325F46C354
:101AEB00FF143D325F46FAFF143A2146D3A3AF32BD
:101AFB005F46C3FF143E673222146D3A83A0347CB5B
:101B08006FC2FF143A3846CBAF3238463A5F46CBFD
:101B18007F2806AF325F461B08572B05E60F32213E
:101B2B00[illegible]
:101B3800CB5FC257193A3A46CBFF322A462A374862
:101B4800221D463A3A46B73A3948200 33A4B4832BA
:101B58002F46323046C327163A2048E5422008 3A34
:101B68000347CB6FC22B1ACDE914C2FF14CDEE1474
:061B7B00C2FF14C357195F
:051B7E00000000000062
:101BB3003A2B45B720073A4E42AF324E42F73A4E10
:101B930042CB472BFB3E02324E42112020ED53003B
:101BA30046ED530246ED530446ED5306462A4B4297
:101BB3000607 0E01110746E5D5C50600EDB0061568
:101BC300C5F7C13A4E42CB572B05C1D1E11BBE1023
:101BD300EFC1D1E11B0C10DF3A4D42D60747E5C5F3
:101BE3001100460108 00EDB00615C5F7C13A4E4293
:101BF300CB572B05C1E1C3901B10EFC1E12310DED1
:101C03000607 0E01E5C511004648 0600EDB0C1C543
:101C13000600214 31CEDB00615C5F7C13A4E42CB71
:101C2300572B05E1E1C3901B10EFC1E1230C10D449
:101C33003E203200463A4E42CBBF324E42C3901B77
:081C43002020202020202020A019
:051C4B00000000000094
:101C5000CD5F1D200CCD1F1D3A2F4232304 2F718A8
:101C6000EF2A0442220142 4FFE012B05FE02C2E58E
:101C70001C1E00CDEB1C6FCDEB1C67CDEB1C47CDCD
:101C8000EB1C7BB7C2E01C79FE012B23FE02C2E0FB
:101C90001C0E06CD051D1E00CDEB1C77 2310F9CDC6
:101CA000EB1C7BB7C2E01C0E06CD051DC3C91C0EB7
:101CB00002CD051D1E004ECD021D2310F97BED4403
:101CC0004FCD051D0E06CD051DC3501C3A0342B76E
:101CD0000CBC547D5E5C5F7C11DFBE1D1C1C9C1E11D
:101CE0000E15CD051DC35E1CC5067B0528F0E5D58B
:101CF000CD5F1DD1E1200 5CD171D18EFF5835FF1F4
:101D0000C1C97BB15FD8B1CB572005CD171D1BF53D
:101D100079D383CDCC1CC9C5D5E5F7E1D1C1C921A3
:101D2000014235C02335C02A0442220142 3E10D36D
:101D3000823E05D3823E43D3803E07D3803E66D3A6
:101D40008121 0B4222094222074 2AF320642320 36E
:101D500042C921201C2204423E00322F421BCB21D1
:101D60000642 7EA72B1C352A09427E2322094211F9
:101D70002B42A7ED522006210B4222094267F6FFB3
:101D80007CC9DB81F5E63028043E45D382F1CB47A0
:101D9000CBDB83C92106427EFE20C8CD821DCB2132
```

```
:101DA000064234240742772322074211 2B42A7ED2D
:091DB000052C0210B42220742C976
:051DB900000000000025
:101DBE0021201C221646221846CD121EF7CD0A1ED1
:101DCE003A4942FE6328F5110A463E621213010A91
:101DDE00002100466DB03E6512210A46060C4E2348
:101DEE00CDF51D10F918D5DB89CB572005CD041E76
:101DFE0018F579D36BC9C5E5F7E1C1C9211B463568
:101E0E00C02335C02A1646221846F7F7F7F73E10BC
:101E1E00D38AAFD38A3E43D3883E07D3883EB8D336
:021E2E0089C960
:101E3000E5470E00D93DCB275F160021731EB7ED95
:101E4000524D44E1D9D90A035F0A0357AFB7ED52A7
:101E5000380330C18FB19D9B7200BCB4120043E209C
:101E60001B02C6301213 0EFF10DBC91027EB0364F6
:101E7000000A000100E5470E00D93DCB275F1600A0
:101E8000217731EB7ED524D44E1D9D90A035F0A030D
:101E900057AFB7ED5238033C18FB19D9C6301213B2
:101EA0000EFF10E6C9FE012B26FE022816FE0328B2
:101EB0000C7CCB3FCB3FCB3FCB3FCDD61E7CE60F40
:101EC000CDD61E7DCB3FCB3FCB3FCB3FCDD61E7D6E
:101ED000E60FCDD61EC9FE0AF2DF1EC6301B02C686
:041EE000371213C9D9
:051EE400000000000000F9
:101EE9003ED1321B46AF321C463201473202473 2AD
:101EF9006B46DD21005 0DD22E51E3E0032E41E3A2C
:101F09002F483246423A3048324742 3A3148324BFD
:101F19004 23A2146D3A8110048 21BB1F06057EB7C6
:101F29002B064F1AED79132 31DF4CD23113A2B45C6
:101F3900B72820F73A4E42E60320FB21C01F224B6A
:101F4900423E09324D423E01324E42F73A4E42E696
:101F59000320FB3A1C4647AF573A1B465F1DB8287D
:101F69001FCB23DD21A71FDD19DD6E00DD23DD6613
:101F790000117F1FD5E9AF573A1B46321C465F1D3A
:101FB900CB23DD21B11FDD19DD6E00DD23DD660008
:101F9900119E1FD5E9F718BB3E01321B46C9CF1F59
:101FA900332CE62665221A383020472E00279E2238
:101FB9008B38A4A0A1A2A3535953544 54D2050DAFC
:061FC90000000000000012
:101FCF003A0846E618F601320846 3E463209463AC6
:101FDF002F483246423A3048324742 3A3148324827
:101FEF00423E023238463E04324E423A0147E6E361
:101FFF00320147 3A2046B706050E10280B3D06065C
:10200F000E08280406040E183A2146E6F0B03221D5
:10201F004679F601320846AF322A463E50322946FB
:10202F00C93A2146E60FF660D3A83221463A034754
:10203F00214722064 0CB4F2009214F220620CB57AA
:10204F00282D3A29463D322946C2FF203A2A46EE2C
:10205F00FF322A463E5028073E28215722060032DB
```

```
:10206F0029463A0846E61BF601B0320846 1B4DD30D
:10207F00A600DBA6EEB0322246CB7F2808ED44EDBA
:10208F005B2C461B04ED5B7746CDF10C7BB72005D2
:10209F007CFE63380226633A2246E680B4322246 3B
:1020AF00CB7F213F222003212F22E67FFE05300325
:1020BF002137223EBC322946AF322A461100460183
:1020CF0008005DB0B720293A2246E67F6F260011AF
:1020DF0005463E02CD751EED5B054621393987ED3C
:1020EF0052280D7A0630FE3538020635 7B3206460C
:1020FF003A0147E6F3320147 3A0846E618F601324D
:10210F000B463A4942324A4247AF3249427BB720ED
:10211F00193A0343B7200932 67463A4E4B326646AA
:10212F00FE462846FE47CACC21C9FE68282ED64156
:10213F00FBFE08F0CDB40D1F22C93E02321B46C96E
:10214F003A2048CBAF322048 3E03321B46C93A20D3
:10215F0048CBAF322048 3E05321B46C93A2048CB08
:10216F00AF322048 3E04321B46C93A2048CBAF322B
:10217F002048 3A0347CB5720343A0846E61BF62151
:10218F003208463A66463D3266462013 3A6746EEB7
:10219F00FF3267463A4E4828033A4F4B3266463A6E
:1021AF006746B7C03A0147F60832014 7C93A2A468F
:1021BF00B7C03A0846E61BF621320846C93A204811
:1021CF00CBAF322048 3A0347CB4F20343A0846E68C
:1021DF001BF641320B463A66463D3266462013 3AB3
:1021EF006746EEFF3267463A4E4828033A4F483269
:1021FF0066463A6746B7C03A0147F604320147C907
:10220F003A2A46B7C03A0846E618F641320846C99B
:10221F0048214921 5D214F2148217921CC216B2172
:10222F004F5045522020202543 4E54522020202528
:10223F0047454152202020254F 50204C494D4954AD
:10224F0047522204C494D49542C2020202020202047
:06225F0000000000000079
:10226500 3A1C463259463A0846321A46AF320846B3
:10227500 3E4E320946214E26224B423E21324D42EB
:10228500 3E05324E42AF325546325646325A4632F6
:10229500 7346 3A3248325B46C93A4E42E603C2CCEF
:1022A500233A5A46B7C295232EFF325A463A554617
:1022B500CDB40DBA22C0221F2366233A5646CB273A
:1022C500CB27217726856F7CCE00671100460104 5B
:1022D50000EDB03E2012133A5646210048856F7C2A
:1022E500CE00677E473A5646FE022804FE04200AC1
:1022F5003A3543D613BB3002477778680826003E45
:1023050003CD301E3A564621C726856F7CCE006721
:10231500 7EB7287C4F08ED791B763A5646CB27CB01
:10232500 2721A326856F7CCE00671100460104 0096
:10233500EDB03A5646 47CB3FCB3FCB3F21204885B2
:10234500 6F7CCE00676E7BE6073C47AF37CB17103A
:10235500FCA5216F2620032173260104 00EDB01B8A
:10236500 2F2A5746110046 3E04CDA51E1104463EB0
```

```
:10237500201213121333A5D466F26003E02CDA51EAC
:10238500 3A5646210046856F7CCE00677E325C4614
:10239500 3A5546FE0220303A5B463D325B462027E1
:1023A500 3A3248325B463A5646210046856F7CCE26
:1023B500 0067 3E20BE280C3A7346FE0128053E20E4
:1023C500 7718043A5C46773A4942324A4247AF3277
:1023D500 4942 78B7CB3E04324E4278FE48CADA25EB
:1023E500 D661FBFE08F047AF32734678CDB40DF6E6
:1023F500 2307242324062446248124C0245225DAD5
:10240500 25C93A5546FE02C03A5646FE07F03CFE3F
:10241500 04C21B243C3C325646AF325A46C93A5593
:10242500 46FE02C03A5646B7CB3DFE05C2362430B3
:10243500 3D325646AF325A46C9001000001100000120
:10244500 000AF325A463256463A3248325B463A5522
:10245500 463CFE033801AF325546FE02C02A5746B8
:10246500 7E325D463A5646CB3FCB27CB27CB27BF9D
:10247500 3004C6371B02C630325C46C93A5546B7ED
:10248500 201B3A56463CFE0B280B325646AF325ABB
:10249500 46C9AF325646325A46C9FE0120103A5651
:1024A500 463CFE0928EC325646AF325A46C93E0133
:1024B500 3273462A57463A5D4677C93A5546B7209C
:1024C500 23AF325A463A56462 1D226856F7CCE0036
:1024D500 6746 3A56462100 48856F7CCE00677EB830
:1024E500 CB3C77C9FE0120263A564647CB3FCB3F2D
:1024F500 CB3F212048856F7CCE00674E7BE6073CB0
:10250500 47AF37CB1710FCB177AF325A46C93A56A9
:10251500 46FE04F23925CB27213E24856F7CCE006B
:10252500 675E23562A5746192257467E325D46AFC7
:10253500 325A46C9D606CB27214224856F7CCE0068
:10254500 673A5D4686325D46AF325A46C93A5546C8
:10255500 B72016AF325A463A56462100 48856F7C59
:10256500 CE00677ED601D877C9FE0120273A5646A8
:10257500 47CB3FCB3FCB3F212048856F7CCE0067C3
:10258500 4E7BE6073C47AF37CB1710FC2FA177AF46
:10259500 325A46C93A5646FE04F2C125CB27213E9A
:1025A500 24856F7CCE00675E23562A5746B7ED52C9
:1025B500 2257467E325D46AF325A46C9D606214278
:1025C500 24CB27856F7CCE00673A5D4696325D4603
:1025D500 AF325A46C93A094811EB03CDF10C160045
:1025E500 226046ED534246F73A0A4811A00FCDF135
:1025F500 0C6C6311060022454 6ED534746F7114523
:10260500 46216046CD840DCD3C2A3A1A46E6183325D
:10261500 0846 3A5946321B46FE023E46320946C036
:10262500 3A5946321C463A464832454 23A474832BB
:10263500 47423A4846324842 3A0748326E463E01D8
:10264500 326F463E00327246C94D41494E54454EA1
:10265500 414E4345204D4F4445520534F4654574125
:10266500 5245205245562032 2E32204F4E20204FC3
```

```
:1026750046464D4F54D34F5053C74F5053CF4752F3
:1026850053C7475253CF4F5043C1475243C150548C
:1026950043C1575443C1534357C9534357C6414395
:1026A50054CD494E54C9534352D4534350D0534348
:1026B50049D04E5250CF5742540241434 1C34E4365
:1026C5004FC9A4A0A1A2A3000000000000FFFFFFC6
:0326D500FFFF6363FFFFFF3FFD
:0326DD001B01FFE2
:0426E000000000000000F4
:1026E6003A0B46E6183208463E46320946AF3223D5
:1026F600463E0132294632 2A46C93A4E42E603C2CE
:1027060022283A2346B720173A1F46B721FD282821
:1027160003210 52C110046010800ED80C3D9273D61
:1027260020363A2046B706050E1021DD2C2B113DFD
:1027360006060E082115 2C280706040E1B211D2C46
:1027460003A2146E6F0B03221467932084611004673
:1027560001080 0EDB0C3D9273D20243A40486F2632
:1027660000110046 3E03CD301E3E20320346 2A416C
:1027760048110446CD6D2B3E22320746C3D9273A6F
:1027860043 48CB7F2802ED44B720162A4448B5B407
:1027960003E00200D21252C110046010800EDB01B41
:1027A600326F2600110046 3E02CD301E3E20320218
:1027B600462A4448110346CD6D2B3A4348473A45CD
:1027C60048B0F2D32721224F2206461B0621224777
:1027D6002206463A2946 3D322946204 03EF0322915
:1027E600463A2A463D322A4620323A334B322A466B
:1027F6003A2346 8721B52B060C281521C12B060A0C
:1028 06003D280D21CB2B06093D280521D42B062971
:1028 1600224B4278324D423E05324E423A494232CE
:1028 2600 4A4247AF324 9427 8B7CB78FE68CA322A68
:1028 3600D641FBFE06F0CDB40D412852285F285144
:1028 4600286C2802294F29C229322AC93E01321B87
:1028 5600463E04324E42C33C2A3E02321B463E04EA
:1028 6600324E42C33C2A3A23463CFE042001AF3294
:1028 7600 2346FE032078 2A6046ED5B6246CB3ACBC0
:1028 8600 1BCB1CCB1D224546ED5347463A4048110B
:1028 9600F401CDF10C1600224946ED534B46F721C3
:1028A6000000224F462A4148CB3CCB1D224D461103
:1028B6004D46214946CD840D1149462145 46CD8FC9
:1028C6000D2A454611EB03CD440D7DB728013D325A
:1028D6006445473A4349CB7F2009BB381178 3243DB
:1028E6004818 0BED44E53B0678ED443243483E04A8
:1028F600324E423E0132294632 2A46C93A2346B76B
:1029060020123A1F46EE01321F4621FD2B282121B7
:1029160052C181C3DC03A20463CFE033801AF325B
:1029260020462 10D2C280921152C3D2803211D2C7C
:1029360011004601080 0EDB03EF0322946 3A334810
:1029460032 2A463E04324E42C93A2346FE02FB2057
:1029560022A4148117D001 9EB21EB03ED5220187B
```

:10296600AF5F573A0948D602473A4048BB8200511A2
:10297600681031804 3C324048ED534148C33E29EDF1
:10298600 5B4448217D0019EB3A4346B4F29E297D09
:10299600B420221195FC1B0A21EB03ED522016AF47
:1029A6005F573A6446473A4348B3200511 6B031807
:1029B600043C32434 9ED534448C33E293A2346FE7D
:1029C60002FB20242A4148118 3FF19EBCB7A2811FB
:1029D600110000 3A4048FE0D28073D324048116B71
:1029E60003ED534145C33E29ED5B444821B3FF195B
:1029F600EB3A4346B4B5282D3A4348B4F2202A218D
:102A060018FCED52201F1100003A6446ED44473A87
:102A160043486B203C1195FC180BCB7A2807116B8C
:102A2600033D324348ED534448C33E293E04321B1E
:102A3600463E04324E422 46046ED5B6246CB3ACBB6
:102A46001BCB1CCB1D224546ED5347463A40481149
:102A5600F401CDF10C16002 24946ED534B46F72101
:102A66000000224F462A4148CB3CCB1D224D461141
:102A76004D46214946CDE40D114946214546CD8F07
:102A86000D2A454611EB03CD440D7DB72B013D3298
:102A96006446473A4348CB7F2006B83B0B7B1B0877
:102AA600ED44BB3801 78ED44324348CB7F2B02ED37
:102AB6004411EB03CDF10CED5B444BCB7A2807E5D9
:102AC6002100 00ED52D1191100000224D46ED534F61
:102AD60046F72149461145 46CDA80D21514611 45D4
:102AE60046CDA80D21454611 4D46CDB40D214946B7
:102AF600114D46CD9F0DF7ED5B454621A983CD19C6
:102B06000D3A4746B72B06EB01A983 09EBED534575
:102B160046ED5B494621A983CD190D3A4B46B72BAB
:102B260006EB01A983 09EB2A45463A4348473A454D
:102B360048B0CB7F2B09ED533B46223D4618072275
:102B46003B46ED533D46ED5B514621A983CD190D1C
:102B56003A5346B7EB2B0401A983091 1F40119CBAE
:102B660025CB14223F46C9CB7C28074D44210000C3
:102B7600ED427DB42B0C017D00AF3CB7ED42FBC2B2
:102B8600802B478080219A2B856F7CCE006701 03BE
:102B960000EDB0C92020A0312FBB312FB4332FBBA3
:102BA600312FB235 2FBB332FB4372FBB2020A04499
:102BB6004953504C4159204D4F4445475549444 58A
:102BC600204D4F4445574542205749445448 5745A0
:102BD60042043454E5445524C494E4520544F20C1
:102BE60050524553532043454E5445524C494E4549
:102BF600204F4646534554205449 4C5420252057CF
:102C06004542205 04F53204F5020454447452047CA
:102C16005220454447452020 43454E5445522020E6
:072C2600205A45524F202007
:062C2D000000000000000A1
:102C33003A0846E61BF602320B46326D463E4632FB
:102C430009463A0748326E463E01326F463E00322D
:102C53007046327246 3A09481EFFCDE10C3EBDCDD7

```
:102C6300410D7D3238483E0032374B3A4648324685
:102C7300423A4748324742423A4848324842AF323AEA
:102C8300463A2048E642C2AF2C3A0347CB6FCAA765
:102C93002C2A3E462241462A3D46224346 3E0132EB
:102CA3003A461B083A0347E606C245353A0047E66E
:102CB300CF32004706 19C5F7C110FB3A2146CB4F67
:102CC3002022E60FF640D3A83EB0D3A1F7D3A60077
:102CD300DBA6EEB0F2DC2CED44B73A0248D3A13EEA
:102CE30010FA512D3A2146CB472022E60FF650D356
:102CF300A83EB0D3A3F7D3A600DBA6EEB0F2052D72
:102D0300ED44B73A0443D3A33E08FA512D3A00479D
:102D1300F63032004706 0FC5F7C110FB3A2048CB07
:102D23005FC2F42DCB6FC2F42D3A2146CB4FC2D0F4
:102D33002DE60FF640D3A33A2548D3A1F7D3A60022
:102D4300DBA6EEB03A0248D3A13E10FAD02D326CB6
:102D5300463EBC3229463A0846326D463A6B463C2B
:102D6300326B463A6B46FE0321BF373E1B380521F3
:102D7300AA373E1E2248423240423E05324E42F7A7
:102D83003A2946 3D322946C29D2D3EBC3229463A88
:102D93006C46473A0846A8320846 3A4942FE41285B
:102DA300093A4E42E6032B8B1BD53E01321B463A88
:102DB3006D46320B463A2F4832 46423A304B324747
:102DC300423A3148324842 3E04324E42C93A2146E1
:102DD300CB472D1DE60FF650D3A83A3548D3A3F7C7
:102DE300D3A600DBA6EEB03A0448D3A33E08F251F3
:102DF3002D3E013238463E013224463E04324E42D5
:102E0300AF322346322A46322546326B463E0532DE
:102E13002946 2A374B221D463A3A46B706043A3924
:102E23004820053A4348D600322F46323046 7B3266
:102E33002846CB21013E2246423E09324D423E0505
:102E4300324E42C93A3846CB6F28073A3A46B7CA98
:102E5300AD2D3A3846CB672822 21E637224B423E36
:102E63000F324D423E05324E42F73A4942FE41CAC5
:102E7300AD2D3A4E42E6032BE01B5E3A2346B7C298
:102E8300A5303A3846CB7F28 0D3E013223463EFF1C
:102E93003228 46C3B9343A0347211437064 0CB4FBF
:102EA300200A211C370620CB57CACA2E3E04324E95
:102EB300423A2946 3D322946C281303A2A46EEFF3C
:102EC300322A463E5028073F28216437060032291D
:102ED300463A0846E61BF602B0320846110046 01A3
:102EE3000800EDB0C381303A0846E61BF60232080E
:102EF300463A2546B7CA192F2144371100460108 1F
:102F030000EDB01105466F26003E02CD751E3E044E
:102F1300324E42C381303A4E42E603C281303A2BF0
:102F23004 6B7C2872F3A3A46B7CA68303A0347C807
:102F33006FCA6830CDE9142031CDCE14202C3A2924
:102F43004 63D322946C281303A2A46EEFF322A46AE
:102F5300210C373EA028053E5021643732294611 03
```

```
:102F6300004601080 0EDB0C381303A3A46FE012B1D
:102F73001321CB37224B423E0F324D423E05324E9B
:102FB30042C37B303A2846B7CA56303D20113A2713
:102F930046 3D322746C28130AF322846C381303D99
:102FA30020603A4348CB7F2802ED44B720162A44D9
:102FB30048B5B43E00200D215C371100460108 0DE
:102FC300EDB01B326F26001100463E02CD301E3E92
:102FD300203202462A4448110346CD6D2B3A43481A
:102FE300473A4548B0F2F32F21224F2206461806EE
:102FF300212247220646 3EFF3227463E0132284618
:10300300 1B7C3D20213A27463D322746C281302194
:103013000A38224B423E04324D423E05324E423E70
:10302300023228461B5B3A40486F26001100463E9F
:10303300003CD301E3E20320346 2A4148110446CDBB
:103043006D2B3E223207463EFF3227463E0332288F
:10305300461B2B217C37224B423E13324D423E050C
:10306300324E421819216C37224B423E10324D42E8
:103073003E05324E42AF322A463E503229463A3856
:10308300 46CB77CA893421D737224B423E0F324D54
:10309300423E05324E42F73A4E42E603C29930C3EE
:1030A3004535FE01C2E3333A2846FEFF20483E047D
:1030B300324E42F73A4E42E60320FB0602C5210497
:1030C300371100460108 00EDB006CBC5F7C110FB73
:1030D300216437110046010800EDB00650C5F7C161
:1030E30010FBC110D83E03322846 3E05322946AFB5
:1030F300322A46C397343A2246CB7F20173A0548F3
:10310300473A2246E67FB830233A0147E67C32014C
:1031130047C330323A0649473A2246E67FB8D2B030
:10312300313A0147E67C320147C330323A0848FE60
:10313300002841 3A6F46FE01280FB73A7246FEB0D7
:10314300DA2C32AF3272461 80DB73A7246FE05DA00
:10315300 2C32AF3272463A6E4647FE002802101FE9
:10316300 3A6F46FE012039AF326F463A084B326E55
:10317300 46C398313A0147F60232014 7C33032 78E9
:10318300326E463A6F46FE01200B3A0147F6023291
:10319300 0147C330323A0147E67C320147C330323C
:1031A3003E01326F463A0748326E4618DD3A084808
:1031B300FE00283F3A6F46FE01280FB73A7246FEDB
:1031C30080DA2C32AF3272461 80CB73A7246FE05DB
:1031D3003857AF3272463A6E4647FE002802101D3A
:1031E3003A6F46FE012035AF326F463A084B326ED9
:1031F300461B1F3A0147F601320147 1B3078326EFC
:10320300463A6F46FE01200A3A0147F6013201476A
:10321300 1B1B3A0147E67C3201471811 3E01326F11
:10322300463A0748326E4618DF3C3272463A284621
:10323300 3D322846FE02F29734CDB40D413254326A
:10324300 45323A2146E60FF670322146D3A8C3979A
:10325300343A3C48322946 3A0347211437 0640CBDB
:103263004F2009211C370620CB572836 3A29463DE3
```

```
:1032730032294 6C2B9343A2A46EEFF322A463E057F
:1032B3002B073E0221643706603229463A0846E6FB
:1032D3001BF602B0320846110046010800EDB0C32B
:1032A300B9343E05322946AF322A463A2546B72875
:1032B300192144371100460108 00EDB01105466FBE
:1032C30026003E02CD751EC39734D3A600DBA6EEBF
:1032D300B0473A2146E60FF660322146D3A978327A
:1032E3002846CB7F2802ED445F3A3E48CDE10C3AB2
:1032F3003F4B477C906730022600 3A2846E680846D
:1033030032284606 40CB7F200206207CB7200206E4
:1033130000 03A08464FE61BF6025F79A0280F3A2EC6
:1033230046B7281 23D322E46200C0600607BB03291
:1033330008467C322E46D3A600DBA6EE803222461B
:10334300CB7F2808ED44ED5B2C461B04ED5B7746F4
:10335300CDF10C7BB720057CFE6238022663 3A224E
:10336300CDF10C7BB720057CFE6238022663 3A224E
:1033630046E680B43222463A1F46B7282921 3C3725
:1033730011004601080 0EDB03A2B460628CB7F28FF
:10338300020 62DE67F6F26001104467B12133ED2D3
:10339300CD751EC389343A2246CB7F21343720037F
:1033A300212437E67FFE05300321 2C371100460127
:1033B3000800EDB03A2246E67F6F26001105463E2F
:1033C30002CD751EED5B05462139398 7ED5228 1044
:1033D3007A0630FE353802063578320646C3B934EC
:1033E300FE02C244343A3846CB6F2007AF3223463D
:1033F300C3B934CDE914200ACDEE142005AF32232E
:1034030046C93A2546B7281E2144371100460108 0C
:1034130000EDB01105466F26003E02CD751E3E0439
:1034230032 4E42C3B9343A4E42E603C2B93421C8DC
:1034300037224B423E0F324D423E05324E42C3B914
:1034430034FE03C297343A4E42E603C2B9343A1FFC
:1034530046B7214C372B0321543711004601080091
:10346300EDB03A29463D322946C2B9343EF03229FD
:1034730046 3A2A463D322A46C2B9343A3348322ABA
:10348300462 1F537224B423E0C324D423E05324E29
:1034930042C3B9343A3846CB6F281B3E0232234627
:1034A300AF3228463A0147E67C3201473A0846E6FE
:1034B3001BF602320B463A494247AF3249427 8B7D2
:1034C300203 33A0343B7201532674632254 63A4E36
:1034D300483266463A0147E6F3320147C9473A2381
:1034E30046B7C03A3A46CB7FC07BFE46CA7036FE2E
:1034F30047CAFC35C9FE68CAE436D641FBFE08F06F
:10350300CDB4000835453518356E359435CD357048
:1035130036FC35E4363A2346FE03C03A5E46322390
:10352300463E04324E423E01322946AF322A463AE3
:10353300464832464 23A4748324742 3A4848324878
:1035430042C93E01321B463A2F48324642 3A3048 7E
:10355300324742 3A3148324842 3A0147E67C320127
:1035630047AF322A463E50322946C93A2346FE0324
```

:1035730000B3E05321B463A2F48324642 3A3048325B
:1035830047423A3148324B423A0147E67C320147E2
:1035930000C93A2346FE03CB3A2346325E463E033207
:1035A30023463E04324E423E01322946322A463AEF
:1035B3002F48324642 3A3049324742 3A314B324B3D
:1035C300423A0147E67C320147C93A2346FE03C02B
:1035D3003A1F46EE01321F46214C37280321543748
:1035E3001100460108 0CEDB03EF03229463A234857
:1035F300322A463E04324E42C93A2346FE03CBB736
:1036030020423A3A46CB7F203B3A0347CB4F202B0D
:1036130003A6646 3D3266462013 3A6746EEFF326706
:1036230046 3A4E4926033A4F48326646 3A6746B709
:1036330020093A0147F604320147C93A0147E6FB3C
:1036430032014 7C93A3D4B473A2546BBF03C32254E
:1036530046 3A2146CB4F20072A41462B2241463A80
:1036630021 46CB47C02A43462322434 6C93A234631
:10367300FE03CBB720423A3A46CB7F203B3A034782
:10368300CB57202B3A66463D3266462013 3A6746AF
:10369300EEFF326746 3A4E4928033A4F4B326646B1
:1036A3003A6746B720093A0147F608320147C93A53
:1036B3000147E6F7320147C93A3048473A2546BB3C
:1036C300F03C322546 3A2146CB4F20072A41462378
:1036D3002241463A2146CB47C02A43462B22434642
:1036E300C93E04321B463A2F48324642 3A3048332EA
:1036F30047423A3148324B423A0147E67C32014771
:10370300C9204C4F434B4544A020524541445920C6
:10371300A04F50204C494D49544752204C494D49E4
:10372300544F504552202020254 34E5452202020F0
:10373300254745415220202025574542202D6E6EB6
:10374300204D4F5645206E6E2020544 94C54202561
:10375300205745420504F532020205A45524F2096
:10376300202020202020202020534 3414E4E45522C
:10377300532053454548494EC75343414E4E455243
:10378300532050524553455454494EC75343414E19
:10379300 4E4552204641554C5420434C45414E2002
:1037A300534 3414E4E45D25343414E4E4552204 61C
:1037B30041554C5420434 14C4C204D41494E5441BA
:1037C3004E454E43C542454C4F5720494E544552F2
:1037D3004C4F43CB534545 4B494E47205449 4D45EB
:1037E3004F55D45745422057494 4544820455252D7
:1037F3004FD24449 53504C4159204D4F44455745AE
:10380300422057494 4544B204F464653455420 20AC
:013813002094
:06381400000000000000AE
:10381A003A0846E61BF604320B463E463209463E5B
:10382A00023238 46F7F73A0147E6EF3201473A20C3
:10383A0048CB7F28293EFFD3A43A2146E60FF660FB
:10384A00322146D3A93E08320147327446 21E5396F
:10385A00224B423E27324D423E05324E42C93EFF7E

```
:10386A00D3A43E67D3A83A0147E603F610320147CC
:10387A0021CC39224B423E09324D423E05324E425C
:10388A00C93A2048CB7FCA21393A7446FE082042F9
:10389A003A0347E604CA7E39D3A600DBA6EEB0CBFC
:1038AA007F2802ED443275463A75461E0ACDE10C70
:1038BA003E14CD410D7D215014CD410D3E02CD4126
:1038CA000D7D1E05CDE10C222C463E043201473205
:1038DA0074463A0347E602CA7E39D3A600DBA6EE4F
:1038EA0080CB7F2802ED443276463A76461E0ACDD0
:1038FA00E10C3E14CD410D7D215014CD410D3E0207
:10390A00CD410D7D1E05CDE10C2277463A2048CBEC
:10391A00BF322048C3693A4E42E6032056060280
:10392A00C521D5391100460108000EDB00650C5F7BA
:10393A00C110FB21DD391100460108000EDB006284F
:10394A00C5F7C110FBC110DB3A2048CB472025AF94
:10395A0006054FC5F7C1D3A600DBA6EEB0CB7F28AC
:10396A0002ED44FE002B04FE0120091DE63A004850
:10397A00D3A4182E3A4942324A4247AF32494278D2
:10398A00B7CBFE68283AD641FBFE08F0CDB40D9BBC
:10399A0039AC39AB39AB39AB39AB39AB39AB39C6E1
:1039AA0039C93A0147E6EF320147060AC5F7C1109D
:1039BA00FB3A2146D3AB3E01321B46C93ED4321BBC
:1039CA0046C943454E544552494EC743454E544550
:1039DA005245C4202020202020202020A043414C4942A7
:1039EA0052415449E4720544944C5420474149E6C
:1039FA0020504152414D455445525320284143508D
:023A0A0047A9CA
:00000001FF
```

APPENDIX B

```
MCS-51' MACRO ASSEMBLER    REMV3

ISIS-II MCS-51 MACRO ASSEMBLER V2.1
OBJECT MODULE PLACED IN :F0:REMV3.OBJ
ASSEMBLER INVOKED BY:  ASM51 REMV3.MAC

LOC  OBJ

0020              17    BIT0    EQU    20H
0032              18    MESS0   EQU    32H
0033              19    MESS1   EQU    33H
0034              20    MESS2   EQU    34H
0035              21    MESS3   EQU    35H
0036              22    MESS4   EQU    36H
0037              23    MESS5   EQU    37H
```

```
0038          24   MESS6   EQU    38H
0039          25   MESS7   EQU    39H
003A          26   MESS8   EQU    3AH
003B          27   MESS9   EQU    3BH
003C          28   TIME    EQU    3CH
003D          29   LCHMSD  EQU    3DH
003E          30   LCHLSD  EQU    3EH
003F          31   KEYM    EQU    3FH
0040          32   DSPLYM  EQU    40H
0007          33   STCK    EQU    07H     ;                    003
008D          34   RELOAD  EQU    8DH
              35   ;##################################################
              36   ;###
              37   ;###
              38   ;###
              39   ;##################################################
00FF          40   PAUSE1  EQU    0FFH
00FF          41   PAUSE2  EQU    0FFH
0040          42   DELAY   EQU    40H
00FF          43   XLNGTH  EQU    0FFH
              44   ;##################################################
              45   ;
              46   ;-----------------------------------------------
0000          47          ORG    00H
              48   ;-----------------------------------------------
0000 020050   49   START:  LJMP   INITL
              50   ;##################################################
              51   ;###
              52   ;###
              53   ;###
              54   ;##################################################
              55   ;
              56   ;-----------------------------------------------
0023          57          ORG    023H
              58   ;-----------------------------------------------
0023 02021A   59   SERPRT: LJMP   INTRPT          ;  JUMP TO RECEIVE MESSAGES
              60   ;##################################################
              61   ;###
              62   ;###
              63   ;###
              64   ;##################################################
              65   ;
              66   ;-----------------------------------------------
0050          67          ORG    50H
              68   ;-----------------------------------------------
0050 758DF4   69   INITL:  MOV    RELOAD,#0F4H    ;
0053 758107   70          MOV    SP,#STCK        ;
0056 759000   71          MOV    P1,#00H         ;
0059 75A000   72          MOV    P2,#00H         ;
005C 75B000   73          MOV    P3,#00H         ;
005F D2B0     74          SETB   P3.0            ;
0061 D2B1     75          SETB   P3.1            ;
0063 D2B6     76          SETB   P3.6            ;
0065 758920   77          MOV    TMOD,#20H       ;
0068 7598D0   78          MOV    SCON,#0D0H      ;
006B 758840   79          MOV    TCON,#40H       ;
```

```
006E 75A890      80          MOV     IE,#90H        ;
0071 75B810      81          MOV!     IP,#10H        ;
0074 7900        82          MOV     R1,#00H
0076 7E00        83          MOV     R6,#00H
0078 7D00        84          MOV     R5,#00H
007A 7C00        85          MOV     R4,#00H
007C C220        86          CLR     BIT0           ;
007E 753846      87          MOV     MESS9,#46H     ;
0081 75324D      88          MOV     MESS0,#4DH     ;
0084 753349      89          MOV     MESS1,#49H     ;
0087 753443      90          MOV     MESS2,#43H     ;
008A 753552      91          MOV     MESS3,#52H     ;
008D 753654      92          MOV     MESS4,#54H     ;
0090 753752      93          MOV     MESS5,#52H     ;
0093 753841      94          MOV     MESS6,#41H     ;
0096 75394B      95          MOV     MESS7,#4BH     ;
0099 753A7F      96          MOV     MESS8,#7FH
009C 1202AB      97          LCALL   DSPLY
009F 1202E6      98          LCALL   LATCH          ;
00A2 1202E6      99          LCALL   LATCH
00A5 753239     100          MOV     MESS0,#39H     ;
00A8 753334     101          MOV     MESS1,#34H     ;
00AB 753430     102          MOV     MESS2,#30H     ;
00AE 753530     103          MOV     MESS3,#30H     ;
00B1 75362A     104          MOV     MESS4,#2AH     ;
00B4 753757     105          MOV     MESS5,#57H     ;
00B7 753847     106          MOV     MESS6,#47H     ;
00BA 753953     107          MOV     MESS7,#53H     ;
00BD 753A00     108          MOV     MESS8,#00H
00C0 1202AB     109          LCALL   DSPLY
00C3 0200C6     110          LJMP    START1
                111     ;*********************************
                112     ;***
                113     ;***
                114     ;***
                115     ;*********************************
00C6 1200F6     116     START1: LCALL   KSCAN          ;
00C9 BE00FA     117             CJNE    R6,#00H,START1 ;
00CC 1202AB     118             LCALL   DSPLY          ;
00CF 80F5       119             SJMP    START1
                120     ;-----------------------------------
                121     ;
                122     ;-----------------------------------------------
00D1 753252     123     INFORM: MOV     MESS0,#52H     ;
00D4 753345     124             MOV     MESS1,#45H     ;
00D7 75344D     125             MOV     MESS2,#4DH     ;
00DA 75352A     126             MOV     MESS3,#2AH     ;
00DD 753620     127             MOV     MESS4,#20H     ;
00E0 75374F     128             MOV     MESS5,#4FH     ;
00E3 753846     129             MOV     MESS6,#46H     ;
00E6 753946     130             MOV     MESS7,#46H     ;
00E9 1202AB     131             LCALL   DSPLY
00EC 0200EF     132             LJMP    DDNH20
00EF AB3B       133     DDNH20: MOV     R3,MESS9       ;
00F1 BB4E02     134             CJNE    R3,#4EH,KSCAN  ;
00F4 80F9       135             SJMP    DDNH20         ;
```

```
                 136   ;*****************************
                 137   ;***
                 138   ;***
                 139   ;***
                 140   ;*****************************
00F6 30870E      141   KSCAN:  JNB     P0.7,KSCAN2     ;
00F9 30D513      142   KSCAN3: JNB     F0,KSCAN1       ;
00FC C2D5        143           CLR     F0              ;
00FE 753F48      144           MOV     KEYM,#48H       ;
0101 753B46      145           MOV     MESS9,#46H      ;
0104 0201E6      146           LJMP    SEND
0107 1201DF      147   KSCAN2: LCALL   TIMER           ;
010A 308759      148           JNB     P0.7,MAINT      ;
010D 80EA        149           SJMP    KSCAN3
                 150   ;-----------------------------------------------
                 151   ;
                 152   ;-----------------------------------------------
010F AB3B        153   KSCAN1: MOV     R3,MESS9        ;
0111 BB4E03      154           CJNE    R3,#4EH,KSCAN4  ;
0114 0200D1      155           LJMP    INFORM          ;
0117 E580        156   KSCAN4: MOV     A,P0            ;
0119 B4FF01      157           CJNE    A,#0FFH,CLOSE1  ;
011C 22          158           RET
011D 1201DF      159   CLOSE1: LCALL   TIMER           ;
0120 E580        160           MOV     A,P0
0122 B4FF01      161           CJNE    A,#0FFH,CLOSE2  ;
0125 22          162           RET
0126 B4FE06      163   CLOSE2: CJNE    A,#0FEH,CLOSE3  ;
0129 753F41      164           MOV     KEYM,#041H      ;
012C 0201E6      165           LJMP    SEND            ;
012F B4FD06      166   CLOSE3: CJNE    A,#0FDH,CLOSE4  ;
0132 753F42      167           MOV     KEYM,#42H       ;
0135 0201E6      168           LJMP    SEND            ;
0138 B4FB06      169   CLOSE4: CJNE    A,#0FBH,CLOSE5  ;
013B 753F43      170           MOV     KEYM,#43H       ;
013E 0201E6      171           LJMP    SEND            ;
0141 B4F706      172   CLOSE5: CJNE    A,#0F7H,CLOSE6  ;
0144 753F44      173           MOV     KEYM,#44H       ;
0147 0201E6      174           LJMP    SEND            ;
014A B4EF06      175   CLOSE6: CJNE    A,#0EFH,CLOSE7  ;
014D 753F45      176           MOV     KEYM,#45H       ;
0150 0201E6      177           LJMP    SEND            ;
0153 B4DF06      178   CLOSE7: CJNE    A,#0DFH,CLOSE8  ;
0156 753F46      179           MOV     KEYM,#46H       ;
0159 0201E6      180           LJMP    SEND            ;
015C B4BF06      181   CLOSE8: CJNE    A,#0BFH,CLOSE9  ;
015F 753F47      182           MOV     KEYM,#47H       ;
0162 0201E6      183           LJMP    SEND            ;
0165 22          184   CLOSE9: RET
                 185   ;-----------------------------------------------
                 186   ;
                 187   ;-----------------------------------------------
0166 20D508      188   MAINT:  JB      F0,MAINT1       ;
0169 D2D5        189           SETB    F0              ;
016B 753F68      190           MOV     KEYM,#68H       ;
016E 0201E6      191           LJMP    SEND
0171 E580        192   MAINT1: MOV     A,P0            ;
```

```
0173 B47F01   193          CJNE   A,#7FH,MAINT2   ;
0176 22       194          RET
0177 1201DF   195  MAINT2: LCALL  TIMER           ;
017A E580     196          MOV    A,P0
017C B47F01   197          CJNE   A,#7FH,MAINT3   ;
017F 22       198          RET
0180 B47E06   199  MAINT3: CJNE   A,#7EH,MAINT4   ;
0183 753F61   200          MOV    KEYM,#61H       ;
0186 0201E6   201          LJMP   SEND            ;
0189 B47D06   202  MAINT4: CJNE   A,#7DH,MAINT5   ;
018C 753F62   203          MOV    KEYM,#62H       ;
018F 0201E6   204          LJMP   SEND            ;
0192 B47B09   205  MAINT5: CJNE   A,#7BH,MAINT6   ;
0195 753F63   206          MOV    KEYM,#63H       ;
0198 1201C3   207          LCALL  RMCHK           ;
019B 0201E6   208          LJMP   SEND            ;
019E B47706   209  MAINT6: CJNE   A,#77H,MAINT7   ;
01A1 753F64   210          MOV    KEYM,#64H       ;
01A4 0201E6   211          LJMP   SEND            ;
01A7 B46F06   212  MAINT7: CJNE   A,#6FH,MAINT8   ;
01AA 753F65   213          MOV    KEYM,#65H       ;
01AD 0201E6   214          LJMP   SEND            ;
01B0 B45F06   215  MAINT8: CJNE   A,#5FH,MAINT9   ;
01B3 753F66   216          MOV    KEYM,#66H       ;
01B6 0201E6   217          LJMP   SEND            ;
01B9 B43F06   218  MAINT9: CJNE   A,#3FH,MAINTA   ;
01BC 753F67   219          MOV    KEYM,#67H       ;
01BF 0201E6   220          LJMP   SEND            ;
01C2 22       221  MAINTA: RET
              222  ;-----------------------------------------------------
              223  ;
              224  ;-----------------------------------------------------
01C3 75322A   225  RMCHK:  MOV    MESS0,#2AH
01C6 753352   226          MOV    MESS1,#52H      ;
01C9 753445   227          MOV    MESS2,#45H      ;
01CC 75354D   228          MOV    MESS3,#4DH      ;
01CF 753643   229          MOV    MESS4,#43H      ;
01D2 753748   230          MOV    MESS5,#48H      ;
01D5 75384B   231          MOV    MESS6,#4BH      ;
01D8 75392A   232          MOV    MESS7,#2AH      ;
01DB 753A00   233          MOV    MESS8,#00H
01DE 22       234          RET
              235  ;-----------------------------------------
              236  ;
              237  ;-----------------------------------------
01DF 753C40   238  TIMER:  MOV    TIME,#DELAY     ;
01E2 D53CFD   239  TIME1:  DJNZ   TIME,TIME1      ;
01E5 22       240          RET
              241  ;-----------------------------------------
              242  ;
              243  ;-----------------------------------------
01E6 7B05     244  SEND:   MOV    R3,#05H
01E8 E53F     245          MOV    A,KEYM
01EA 20D01A   246          JB     P,PRTYX         ;
01ED C29B     247          CLR    TB8             ;
01EF BC00FD   248  SEND1:  CJNE   R4,#00H,SEND1    ;
```

```
01F2 853F99     249          MOV    SBUF,KEYM       ;
01F5 7C01       250          MOV    R4,#01H         ;
01F7 BE000A     251          CJNE   R6,#00H,SEND2
01FA E53F       252          MOV    A,KEYM
01FC B46302     253          CJNE   A,#63H,SEND3    ;
01FF 7B0A       254          MOV    R3,#0AH         ;
0201 1202AB     255  SEND3:  LCALL  DSPLY
0204 DBE9       256  SEND2:  DJNZ   R3,SEND1
0206 22         257          RET
0207 D29B       258  PRTYX:  SETB   TB8             ;
0209 BC00FD     259  PRTYX1: CJNE   R4,#00H,PRTYX1   ;
020C 853F99     260          MOV    SBUF,KEYM       ;
020F 7C01       261          MOV    R4,#01H         ;
0211 BE0003     262          CJNE   R6,#00H,PRTYX2
0214 1202AB     263          LCALL  DSPLY
0217 DBF0       264  PRTYX2: DJNZ   R3,PRTYX1
0219 22         265          RET
                266  ;*****************************************************
                267  ;***
                268  ;***
                269  ;***
                270  ;*****************************************************
021A 109807     271  INTRPT: JBC    RI,RECEVE       ;
021D 109901     272          JBC    TI,WRONG        ;
0220 32         273          RETI
0221 7C00       274  WRONG:  MOV    R4,#00H         ;
0223 32         275          RETI                   ;
0224 E599       276  RECEVE: MOV    A,SBUF          ;
0226 20D005     277          JB     P,PRTY1         ;
0229 209A60     278          JB     RB8,WRONGP
022C 8006       279          SJMP   PRTY2
022E 209A03     280  PRTY1:  JB     RB8,PRTY2       ;
0231 02028C     281          LJMP   WRONGP
0234 B46205     282  PRTY2:  CJNE   A,#062H,RCEVE1  ;
0237 7E01       283          MOV    R6,#01H         ;
0239 C220       284          CLR    BIT0            ;
023B 32         285          RETI
023C BE0104     286  RCEVE1: CJNE   R6,#01H,RCEVE2  ;
023F F532       287          MOV    MESS0,A         ;
0241 0E         288          INC    R6              ;
0242 32         289          RETI
0243 BE0204     290  RCEVE2: CJNE   R6,#02H,RCEVE3  ;
0246 F533       291          MOV    MESS1,A         ;
0248 0E         292          INC    R6              ;
0249 32         293          RETI
024A BE0304     294  RCEVE3: CJNE   R6,#03H,RCEVE4  ;
024D F534       295          MOV    MESS2,A         ;
024F 0E         296          INC    R6              ;
0250 32         297          RETI
0251 BE0404     298  RCEVE4: CJNE   R6,#04H,RCEVE5  ;
0254 F535       299          MOV    MESS3,A         ;
0256 0E         300          INC    R6              ;
0257 32         301          RETI
0258 BE0504     302  RCEVE5: CJNE   R6,#05H,RCEVE6  ;
025B F536       303          MOV    MESS4,A         ;
025D 0E         304          INC    R6              ;
```

```
025E 32          305          RETI
025F BE0604      306  RCEVE6: CJNE   R6,#06H,RCEVE7  ;
0262 F537        307          MOV    MESS5,A         ;
0264 0E          308          INC    R6              ;
0265 32          309          RETI
0266 BE0704      310  RCEVE7: CJNE   R6,#07H,RCEVE8  ;
0269 F538        311          MOV    MESS6,A         ;
026B 0E          312          INC    R6              ;
026C 32          313          RETI
026D BE0804      314  RCEVE8: CJNE   R6,#08H,RCEVE9  ;
0270 F539        315          MOV    MESS7,A         ;
0272 0E          316          INC    R6              ;
0273 32          317          RETI
0274 BE0904      318  RCEVE9: CJNE   R6,#09H,RCEVEA  ;
0277 F53A        319          MOV    MESS8,A         ;
0279 0E          320          INC    R6              ;
027A 32          321          RETI
027B BE0A04      322  RCEVEA: CJNE   R6,#0AH,RCEVEB  ;
027E F53B        323          MOV    MESS9,A         ;
0280 0E          324          INC    R6              ;
0281 32          325          RETI
0282 BE0B06      326  RCEVEB: CJNE   R6,#0BH,WRONGR  ;
0285 B46503      327          CJNE   A,#065H,WRONGR  ;
0288 7E00        328          MOV    R6,#00H         ;
028A 32          329          RETI
028B 32          330  WRONGR: RETI
028C D220        331  WRONGP: SETB   BIT0            ;
028E 32          332          RETI
                 333  ;-----------------------------------------------------------
                 334  ;
                 335  ;-----------------------------------------------------------
028F C220        336  PRTYED: CLR    BIT0            ;
0291 75322A      337          MOV    MESS0,#2AH      ;
0294 753350      338          MOV    MESS1,#50H      ;
0297 753441      339          MOV    MESS2,#41H      ;
029A 753552      340          MOV    MESS3,#52H      ;
029D 753649      341          MOV    MESS4,#49H      ;
02A0 753754      342          MOV    MESS5,#54H      ;
02A3 753859      343          MOV    MESS6,#59H      ;
02A6 75392A      344          MOV    MESS7,#2AH      ;
02A9 8000        345          SJMP   DSPLY
                 346  ;***********************************************************
                 347  ;***
                 348  ;***
                 349  ;***
                 350  ;***********************************************************
02AB 2020E1      351  DSPLY:  JB     BIT0,PRTYED     ;
02AE 7932        352          MOV    R1,#032H        ;
02B0 7D17        353          MOV    R5,#17H         ;
02B2 D2B7        354          SETB   P3.7            ;
02B4 8740        355  DSPLY1: MOV    DSPLYM,@R1      ;
02B6 8DA0        356          MOV    P2,R5           ;
02B8 854090      357          MOV    P1,DSPLYM       ;
02BB C2B7        358          CLR    P3.7            ;
02BD 00          359          NOP                    ;
02BE D2B7        360          SETB   P3.7            ;
02C0 1D          361          DEC    R5              ;
```

```
02C1 09          362          INC    R1                ;
02C2 B936EF      363          CJNE   R1,#36H,DSPLY1    ;
02C5 7D1B        364          MOV    R5,#1BH           ;
02C7 8740        365  DSPLY2: MOV    DSPLYM,@R1        ;
02C9 8DA0        366          MOV    P2,R5             ;
02CB 854090      367          MOV    P1,DSPLYM         ;
02CE C2B7        368          CLR    P3.7              ;
02D0 00          369          NOP                      ;
02D1 D2B7        370          SETB   P3.7              ;
02D3 1D          371          DEC    R5                ;
02D4 09          372          INC    R1                ;
02D5 B93AEF      373          CJNE   R1,#3AH,DSPLY2    ;
02D8 75A00D      374          MOV    P2,#0DH           ;
02DB 8740        375          MOV    DSPLYM,@R1        ;
02DD 854090      376          MOV    P1,DSPLYM         ;
02E0 C2B7        377          CLR    P3.7              ;
02E2 00          378          NOP                      ;
02E3 D2B7        379          SETB   P3.7              ;
02E5 22          380          RET
                 381  ;-----------------------------------
                 382  ;
                 383  ;-----------------------------------
02E6 753DFF      384  LATCH:  MOV    LCHMSD,#PAUSE1    ;
02E9 753EFF      385          MOV    LCHLSD,#PAUSE2    ;
02EC E53E        386  LATCH1: MOV    A,LCHLSD
02EE 6009        387          JZ     LATCH2
02F0 D53EF9      388          DJNZ   LCHLSD,LATCH1     ;
02F3 E53D        389          MOV    A,LCHMSD          ;
02F5 B40001      390          CJNE   A,#00H,LATCH2     ;
02F8 22          391          RET                      ;
02F9 753EFF      392  LATCH2: MOV    LCHLSD,#0FFH
02FC 153D        393          DEC    LCHMSD
02FE 80EC        394          SJMP   LATCH1
                 395  ;-----------------------------------
0FFD             396          ORG    0FFDH
                 397  ;-----------------------------------
0FFD 020000      398          LJMP   START             ;
                 399          END
```

What is claimed is:

1. A web guidance system for automatically controlling alignment of a moving web, comprising:

a stationary support frame;

a pivotable frame attached to the stationary support frame for receiving the moving web, and being pivotable over a predetermined range and including parallel steering rollers rotatable about an axis extending transversely of the web direction of travel;

sensing means including at least one edge sensor for sensing a transverse deviation in the position of a longitudinal edge of the web and for generating an error signal in response thereto;

control means for generating control signals responsive to the error signals for automatically correcting the deviation of the web position by pivoting the pivotable frame;

drive means for pivoting the pivotable frame to control the angular position of said pivotable frame responsive to the control signals;

manual means for enabling an operator to assume manual control of the drive means; memory means having a plurality of memory locations for storage of operational data and maintenance means for disabling operation of the control means providing selectable and programmable maintenance modes of operation to permit operator entry of programmable parameters from a control panel, wherein the maintenance means comprises means for enabling the operator to select desired functions and maintenance modes including a mode which enables an operator to address any memory location of the memory means and store selected data of the addressed memory location.

2. The web guidance system of claim 1 wherein the maintenance means comprises testing means for testing the edge sensors by activating each edge sensor to obtain a full scale sensor error signal output and comparing the full scale sensor error signal output to a threshold and generating a maintenance message if the full scale sensor level is below the threshold.

3. The web guidance system of claim 1 wherein the drive means further comprises measuring means for generating position signals responsive to the angular displacement of the pivotable frame and means for automatically calibrating the measuring means by automatically driving the pivotable frame to angular extremes of the predetermined range, determining a full scale position signal value for each extreme, and utilizing the full scale position signal value to automatically the measuring means by percentage of maximum angular displacement.

4. The web guidance system of claim 1 wherein the control means further comprises a plurality of control panels for enabling operator selection of desired functions and wherein the maintenance means further comprises means for disabling all but one of the control panels when a maintenance mode of operation is selected by the operator.

5. The web guidance system of claim 1 wherein the sensing means comprises two edge sensors and the control means comprises means for enabling operator numerical programming of a spacing distance between the sensors and operator programming of sensor activation.

6. The web guidance system of claim 1 wherein the drive means comprises a motor having a selectable speed and the maintenance means comprises means for enabling the operator to numerically program the motor speed.

7. A web guidance system for automatically controlling alignment of a moving web, comprising:

a stationary support frame;

a pivotable frame attached to the stationary support frame for receiving the moving web, and being pivotable over a predetermined range and including parallel steering rollers rotatable about an axis extending transversely of the web direction of travel;

sensing means including at least one edge sensor for sensing a transverse deviation in the position of a longitudinal edge of the web and for generating an error signal in response thereto;

control means for generating control signals responsive to the error signals for automatically correcting the deviation of the web position by pivoting the pivotable frame;

drive means for pivoting the pivotable frame to control the angular position of said pivotable frame responsive to the control signals;

manual means for enabling an operator to assume manual control of the drive means; and testing means for testing' the edge sensors by activating each edge sensor to obtain a full scale sensor error signal output and comparing full scale sensor, error signal output to a threshold and generating a maintenance message if the full scale sensor level is below the threshold.

8. The web guidance system of claim 7 wherein the test means tests the sensor automatically before the sensors are positioned along the longitudinal edge of the web.

9. The web guidance system of claim 7 wherein the testing means further comprises means for automatically calibrating the edge sensors by activating each sensor and adjusting the gain of an amplifier coupled thereto to obtain a desired sensor error signal level in response to the full scale sensor error signal exceeding the threshold

10. The web guidance system of claim 7 wherein each edge sensor comprises a light source and wherein the web guidance system further comprises verifying means for automatically activating each edge sensor light source to obtain a full scale output signal and then deactivating each edge sensor light source to obtain a zero scale output signal and for verifying that the edge sensors are functioning responsive to the full scale and zero scale output signal.

11. A web guidance system for automatically controlling alignment of a moving web, comprising:

a stationary support frame;

a pivotable frame attached to the stationary support frame for receiving the moving web, and being pivotable over a predetermined range and including parallel steering rollers rotatable about an axis extending transversely of the web direction of travel;

sensing means including at least one edge sensor for sensing a transverse deviation in the position of a longitudinal edge of the web and for generating an error signal in response thereto;

control means for generating control signals responsive to the error signals for automatically correcting the deviation of the web position by pivoting the pivotable frame;

drive means for pivoting the pivotable frame to control the angular position of said pivotable frame responsive to the control signals;

manual means for enabling an operator to assume manual control of the drive means; and measuring means for generating position signals responsive to the angular displacement of the pivotable frame and means for calibrating the measuring means by automatically driving the pivotable frame to angular extremes of the predetermined range, determining a full scale position signal value for each extreme, and utilizing the full scale position signal value to calibrate the measuring means by percentage of maximum angular displacement.

12. The web guidance system of claim 11 comprising means for setting a caution trip point as a percent of total maximum pivotable frame angular displacement and further comprising means for generating a paster feedback signal having a pulse width to permit correction of undesired pivotable frame angular displacement responsive to the pivotable frame angular displacement exceeding the caution trip point.

13. The web guidance system of claim 12 comprising means for enabling an operator to enter a pulse time for the paster feedback signal and a wait time during which additional generation of paster feedback signals are disabled

14. The web guidance system of claim 11 further comprising moving means for automatically moving the edge sensors away from the web in response to an interlock dropout signal.

15. The web guidance system of claim 14 wherein the moving means further comprising means for automatically centering the pivotable frame in response to the interlock dropout signal.

16. The web guidance system of claim 14 further comprising means for automatically storing for a predetermined period of time the angular position of the pivotable frame and for automatically returning the pivotable frame to an angular position it had the predetermined time prior to detection of the interlock dropout signal.

17. The web guidance system of claim 11 further comprising means for disabling the generation of control signals for automatically correcting the deviation of the web responsive to an interlock dropout signal and for generating control signal to center the pivotable frame in response to the interlock dropout signal.

* * * * *

UNITED STATES PATENT AND TRADEMARK OFFICE

CERTIFICATE OF CORRECTION

PATENT NO. :4,991,761

DATED :February 12, 1991

INVENTOR(S) :Gnuechtel et al.

It is certified that error appears in the above-identified patent and that said Letters Patent is hereby corrected as shown below:

Column 2, line 25, "conduction" should be --conjunction--.

Column 3, line 41, after "steering", insert --roller--.

Column 3, line 60, "an" should be --a--.

Column 4, line 44, before "specific", insert --a--.

Column 4, line 68, before "constructed" insert --Each sensor is--.

Column 5, line 3, delete "illustrant", and insert --illustrated embodiment--.

Column 6, line 33, after "operator", insert --.--.

Column 6, line 59, after "used", insert --.--.

Column 8, line 11, "I" should be --In--.

Column 65, line 14, after "automatically", insert --calibrate--.

Column 65, line 56, "testing"' should be--testing--.

UNITED STATES PATENT AND TRADEMARK OFFICE

CERTIFICATE OF CORRECTION

PATENT NO. : 4,991,761

DATED : February 12, 1991

INVENTOR(S) : Gnuechtel et al.

It is certified that error appears in the above-identified patent and that said Letters Patent is hereby corrected as shown below:

Column 65, line 58, after "sensor", delete ",".

Column 66, line 4, after "threshold", insert --.--.

Signed and Sealed this

Third Day of November, 1992

*Attest:*

DOUGLAS B. COMER

*Attesting Officer*

*Acting Commissioner of Patents and Trademarks*